US006191525B1

(12) United States Patent
Tanaka et al.

(10) Patent No.: US 6,191,525 B1
(45) Date of Patent: Feb. 20, 2001

(54) SPARK PLUG

(75) Inventors: Yutaka Tanaka; Makoto Sugimoto, both of Aichi (JP)

(73) Assignee: NGK Spark Plug Co., Ltd., Aichi (JP)

( * ) Notice: Under 35 U.S.C. 154(b), the term of this patent shall be extended for 0 days.

(21) Appl. No.: 09/140,742

(22) Filed: Aug. 26, 1998

(30) Foreign Application Priority Data

Aug. 27, 1997 (JP) ..... 9-231282
Dec. 18, 1997 (JP) ..... 9-364921
Dec. 18, 1997 (JP) ..... 9-364922

(51) Int. Cl.[7] ..... H01T 13/20; H01T 13/22; H01T 13/34; H01T 13/36; F02P 1/00

(52) U.S. Cl. ..... 313/141; 313/143; 313/144; 313/145; 123/169 EL

(58) Field of Search ..... 313/118, 119, 313/134, 135, 136, 141, 143, 144, 145; 123/169 EL, 169 R, 169 CB

(56) References Cited

U.S. PATENT DOCUMENTS 4,814,665 * 3/1989 Sakura et al. ..... 313/141
4,949,006 * 8/1990 Oshima et al. ..... 313/144
5,017,826 * 5/1991 Oshima et al. ..... 313/142
5,760,533 * 6/1998 Saiki et al. ..... 313/135 X
5,869,921 * 2/1999 Matsutani et al. ..... 313/141

FOREIGN PATENT DOCUMENTS 0 484 168 A3 5/1992 (EP) ..... H01T/13/39
0 484 186 A2 5/1992 (EP) ..... H01T/13/39

* cited by examiner

*Primary Examiner*—Michael H. Day
*Assistant Examiner*—Mack Haynes
(74) *Attorney, Agent, or Firm*—Snider & Associates; Ronald R. Snider

(57) ABSTRACT

In a spark plug, a resistor is placed between a terminal and a center electrode within a through hole of an insulator. The through hole of the insulator has a first portion which allows the center electrode to be inserted therethrough, and a second portion which is formed on a rear side of the first portion so as to be larger in diameter than the first portion and which accommodates the resistor therein, where the second portion is connected to the first portion via a connecting portion including a two- or more-stepped reduced-diameter portion. Then, an electrically conductive glass seal layer is placed at a position corresponding to the connecting portion between the resistor and the center electrode. When the glass seal layer is formed by filling electrically conductive glass powder and its heating and compression, the pressurizing cross-sectional area in the axial direction is reduced to an extent of diameter reduction by the reduced-diameter portion of the connecting portion, so that a sufficient compressing force can be ensured in the event that the pressurizing force is lost, for example, due to friction between the upper filler material (e.g., resistor material powder) and the wall surface of the through hole. By virtue of this arrangement, the sintering of the glass seal layer progresses sufficiently so that the burns of carbon in the glass seal portion and the oxidization of metal components become unlikely to occur. Thus, such trouble as increase in conduction resistance can be avoided over a long term.

18 Claims, 17 Drawing Sheets

FIG. 15

| Taper angle of flange receiving portion | Impact resistance according to paragraph 3. 3 of JISB8031 |
|---|---|
| +0° from taper angle of center electrode receiving portion | ○<br>○<br>○<br>○<br>○ |
| +5° from taper angle of center electrode receiving portion | ○<br>○<br>○<br>○<br>○ |
| +7° from taper angle of center electrode receiving portion | ○<br>×<br>×<br>○<br>× |

○: Satisfying the specification.
×: Not satisfying the specification.

SPARK PLUG

BACKGROUND OF THE INVENTION

This application claims the priority of Japanese Patent Applications No. H9-231282 filed on Aug. 27, 1997, No. H9-364921 filed on Dec. 18, 1997 and No. H9-364922 filed on Dec. 18, 1997, which are incorporated herein by reference.

The present invention relates to spark plugs to be used for internal combustion engines and, more particularly, to a spark plug into which a resistor for prevention of occurrence of radio frequency noise is incorporated.

As this type of spark plug, there has conventionally been known one having a structure that a terminal is inserted and fixed into a through hole formed along the axial direction of an insulator from one end side of the through hole while a center electrode is similarly inserted and fixed thereinto from the other end side of the through hole, where a resistor is placed between the terminal and the center electrode within the through hole. Between the resistor and the terminal or between the resistor and the center electrode, generally, an electrically conductive glass seal portion for joining together the two members is placed. This spark plug is manufactured, for example, by the following process.

That is, into the through hole of the insulator, after the center electrode is inserted, conductive glass powder is filled, then material powder of the resistor composition is filled, and further conductive glass powder is filled again. As a result, in the through hole, a conductive glass powder layer, a resistor composition powder layer and another conductive glass powder layer are formed in this order from the center electrode side. Then, in this state, the insulator is heated above the glass softening point, and further a terminal is press fitted into the hole from the side opposite to the center electrode, in which arrangement the stacked layers are pressed axially so as to be compressed and sintered, thus forming a conductive glass seal portion, a resistor and another conductive glass seal portion, respectively.

In the above spark plug manufacturing method, it has been practiced that after the conductive glass powder layer, the resistor composition powder layer and another conductive glass powder layer are formed one after another and heated with the center electrode downside, the individual layers are compressed in one axial direction from the side opposite to the center electrode, by which the glass seal portions and the resistor are formed. In this case, there are some cases where enough pressing force does not act on the conductive glass powder layer located at the lowest side because of friction between the upper filler material and the through hole wall surface, so that the compression or fluidization after the glass melting and moreover the sintering of the conductive glass powder layer do not proceed enough. If the spark plug is used for a long time in such a state, it may occur that carbon in the conductive glass seal portion burns out or the metal component oxidizes so that the conducting state between the resistor and the center electrode becomes incomplete, causing the conduction resistance to increase, which may obstruct the normal ignition.

Also, when the outside dimensions of the insulator are specified by specifications of the spark plug or the like, increase in the length of the resistor is limited. In this case, one available method would be that the place of the protruding-portion receiving surface is moved toward the front end of the center electrode, so that the axial length of the second portion of the through hole is extended, by which the length of the resistor is increased by the portion.

However, this method has a disadvantage that the insulator is thinned in wall thickness at the position of the protruding-portion receiving surface so that the strength of this portion is likely to lack. In this case, the crossing portion between the protruding-portion receiving surface and the second portion may serve as a kind of notch, which often causes problems in terms of strength.

Next, there is a further problem other than the above. That is, in the conventional spark plug, as shown in FIG. 16, the taper angle of a center electrode receiving portion 104 formed in a through hole 103 of an insulator 102 (where the taper angle is an angle as viewed from a reference surface that crosses the center axis line of the through hole 103) is set to 20°–40°. Then, the present inventors have found out that the conventional spark plug (in which the taper angle of the center electrode receiving portion 104 is 20°–40°) has the following disadvantage. That is, because a clearance (seal portion) 109 between an electrode-fixing protruding portion 105 and a through hole inner wall 107 of a proximity 106 of a center electrode receiving portion is narrow and deep, a conductive glass powder layer 108 in the glass seal is not fluidized enough, so that the conductive glass seal portion 109 is liable to become nonuniform in compactness. In particular, the conductive glass powder layer 108 of the proximity 106 of the center-electrode receiving portion is liable to lower in vitrifiability, which may cause a problem of deterioration in thermal conductivity. Further, poor vitrifiability of the conductive glass seal portion 109 would lead to deterioration in heat performance (anti-preignition performance) of the spark plug, while occurrence of nonuniformity in compactness of the conductive glass seal portion 109 would lead to variations in the heat performance from product to product, as further disadvantages.

SUMMARY OF THE INVENTION

A first object of the present invention is to provide a spark plug which can be improved in the conducting state between the resistor and the center electrode with the glass seal portion sandwiched therebetween. A second object of the present invention is to provide a spark plug which can be increased in the length of the resistor even when outside dimensions of the insulator are limited, and which is superior in the radio frequency noise prevention effect. Further, a third object of the present invention is to provide a spark plug which has been designed for improvement in the vitrifiability as well as stabilization in compactness of the clearance (seal portion) between the electrode-fixing protruding portion and the through hole inner wall of the center-electrode receiving portion, and which has realized improvement and stabilization of heat performance.

The spark plug of the present invention has a constitution that, to a through hole formed along an axial direction of an insulator, a terminal is inserted and fixed on one end side of the through hole while a center electrode is inserted and fixed on the other end side of the through hole, and a resistor is placed between the terminal and the center electrode within the through hole, and with a view to achieving the above first object, being characterized in that:

a stem cross-section diameter of the center electrode is set smaller than a stem cross-section diameter of the resistor, and with one side toward a tip end of the center electrode taken as a front side, the through hole of the insulator has a first portion which allows the center electrode to be inserted therethrough, and a second portion which is formed on a rear side of the first portion so as to be larger in diameter than the first portion and which accommodates the resistor therein, where the second portion is connected to the first portion via a connecting portion including a two- or more-stepped reduced-diameter portion; and that an electrically conductive glass seal portion is placed at a position corresponding to the connecting portion between the resistor and the center electrode.

In this spark plug, a connecting portion including a two- or more-stopped reduced-diameter portion is formed between the second portion of a larger diameter at which the resistor is placed in the through hole of the insulator, and the first portion of a smaller diameter into which the center electrode is inserted, and an electrically conductive glass seal portion is placed at a position corresponding to the connecting portion between the resistor and the center electrode. With this constitution, when the glass seal portion is formed by filling electrically conductive glass powder and its heating and compression, the pressurizing cross-sectional area in the axial direction is reduced to an extent of diameter reduction by the reduced-diameter portion, so that a sufficient compressing force can be ensured in event that the pressurizing force is lost, for example, due to friction between the upper filler material (e.g., resistor material powder) and the wall surface of the through hole. Once the compressing force is ensured, the sintering of the glass powder layer progresses sufficiently so that the burns of carbon in the glass seal portion and the oxidization of metal components become unlikely to occur. Thus, a conducting state via the glass seal portion can be ensured between the resistor and the center electrode with ease and in a successful state and moreover such trouble as increase in conduction resistance can be avoided over a long term.

Next, an electrode-fixing protruding portion may be provided at a rear end portion of the center electrode so as to be protruded outward from its outer circumferential surface. Further, at the connecting portion, a protruding-portion receiving surface for receiving the electrode-fixing protruding portion may be formed so as to be adjacent to a rear end edge of the first portion and to be projected outward from the inner circumferential surface of the first portion. In this case, a projecting surface may be formed in correspondence to a position at which an outward extended surface of the protruding-portion receiving surface and an extended surface of the second portion toward the protruding-portion receiving surface cross each other, so that the projecting surface stretches over these two extended surfaces.

If a projecting portion (the surface thereof is the projecting surface mentioned above) is formed in correspondence to the position at which the outward extended surface of the protruding-portion receiving surface and the extended surface of the second portion toward the protruding-portion receiving surface cross each other so that: the projecting portion is projected from those two extended surfaces, then the spatial volume between the side face of the electrode-fixing protruding portion and the second portion is reduced so that the compressing force for the electrically conductive glass powder layer to be filled can be enhanced. Thus, the aforementioned effects of the present invention characterized by achieved remarkably.

Moreover, by providing such a projecting portion, the following additional effects can also be achieved in combination. That is, even if the position of the protruding-portion receiving surface is changed to extend the axial length of the second portion, the projecting portion is formed so as to stretch the individual extended surfaces of the protruding-portion receiving surface and the second portion, thus preventing the insulator from being thinned in wall thickness as mentioned above. Further, because the crossing portion of the extended surfaces is buried in the projecting portion, the notch effect is alleviated. As a result, the length of the resistor can be increased while a sufficient strength of the insulator is ensured, so that a spark plug superior in radio frequency noise preventing performance can be realized. Thus, the second object of the present invention can be solved.

For the spark plug of the present invention, it is desirable that, in a cross section including a center axis line of the insulator, if a distance in the direction of the center axis line from a connecting point P between the protruding-portion receiving surface and the first portion to a connecting point S between the projecting surface and the second portion is 1 and a distance in the direction of the center axis line from the connecting point P to the rear end edge of the center electrode is L, then a value of l/L is not less than 0.5. If the value of l/L becomes less than 0.5, then the narrow gap portion between the projecting surface and the side face of the electrode-fixing protruding portion of the center electrode is formed excessively long along the direction of the center axis line of the insulator so that insufficient filling of the electrically conductive glass powder layer to the portion may result in some cases.

More specifically, the second portion of the through hole may be formed into a generally cylindrical surface, and the projecting surface of the connecting portion may be formed so as to have a generally cylindrical shell surface which is connected to the protruding-portion receiving surface and arranged concentrically with the second portion, and a reduced-diameter surface which connects the second portion and the shell surface to each other. The connecting portion having such a configuration is superior especially in strength, and has an advantage that the withstand voltage of the insulator can be improved.

With an inner diameter of the second portion of the through hole expressed as D and with an inner diameter of the shell surface expressed as d, a value of d/D is preferably adjusted to within a range of 0.5–0.95. If the value of d/D becomes less than 0.5, then the connecting portion is excessively reduced in diameter so that the gap between the shell surface and the side face of the electrode-fixing protruding portion becomes extremely narrow so that the filling of the electrically conductive glass powder layer may be obstructed. On the other hand, if the value of d/D exceeds 0.95, the diameter reduction of the connecting portion becomes insufficient so that the effect of increase in the compressing force for the electrically conductive glass powder layer could not be expected so much and, therefore, the expected effects of the present invention could not be achieved in some cases. In addition, the value of d/D is, more desirably, adjusted within a range of 0.75–0.8.

Also, the reduced-diameter surface of the projecting surface may be formed into a taper surface which is sloped upgrade toward the outside when the insulator is positioned upright with the first portion of the through hole down. With this arrangement, because the reduced-diameter portion is formed by the taper surface at a position close to the end face of the resistor, the compressing effect for the electrically conductive glass powder layer is enhanced at the position so that the conducting state between the resistor and the center electrode via the glass seal portion can be made further successful. Further, the angle formed by the second portion of the through hole and the reduced-diameter portion becomes an obtuse angle, making the notch effect rather unlikely to occur at their connecting portion, and thus giving an advantage that the strength of the insulator is improved.

In this case, the aforementioned protruding-portion receiving surface is also preferably a similar taper surface.

Besides, it is preferable that, with a plane perpendicular to the center axis line of the through hole taken as a reference plane, the slope angle of the reduced-diameter surface to the reference plane is adjusted within a range of 20–80°. If the slope angle is less than 20°, then the direction of the taper surface largely counters the direction of compression of the electrically conductive glass powder, causing the flow of powder to be obstructed so that the electrically conductive glass seal portion is formed nonuniform, in which case the conducting state between the resistor and the center electrode may deteriorate, conversely. On the other hand, if the slope angle exceeds 80°, then the length of the taper surface in the direction of the center axis line of the through hole becomes very long, so that the expected diameter-reduction effect and moreover the compression effect of the electrically conductive glass powder layer could not be achieved in some cases.

Next, as a second constitution, the spark plug according to the present invention has a constitution that, to a through hole formed along an axial direction of an insulator, a terminal is inserted and fixed on one end side of the through hole while a center electrode is inserted and fixed on the other end side of the through hole, and a resistor is placed between the terminal and the center electrode within the through hole, and with a view to achieving the above object, being characterized in that:

a stem cross-section diameter of the center electrode is set smaller than a stem cross-section diameter of the resistor, and with one side toward a tip end of the center electrode taken as a front side, the through hole of the insulator has a first portion which allows the center electrode to be inserted therethrough, and a second portion which is formed on a rear side of the first portion so as to be larger in diameter than the first portion and which accommodates the resistor therein;

an electrode-fixing protruding portion is formed at a rear end portion of the center electrode so as to be projected outward from an outer circumferential surface of the center electrode; and that at a connecting portion between the first portion and the second portion, a protruding-portion receiving surface for receiving the electrode-fixing protruding portion is formed in such a shape as to be adjacent to a rear end edge of the first portion and be projected outward from an inner circumferential surface of the first portion, and further, a projecting portion of inward protrusion is formed in correspondence to a position at which an outward extended surface of the protruding-portion receiving surface and an extended surface of the second portion toward the protruding-portion receiving surface side cross each other, so that the projecting portion stretches over these two extended surfaces. With this constitution, the aforementioned second object of the present invention can be achieved.

Concretely, the second portion of the through hole may be formed into a generally cylindrical surface, and a surface (a projecting surface) of the projecting portion of the connecting portion has a generally cylindrical shell surface which is connected to the protruding-portion receiving surface and arranged concentrically with the second portion, and a reduced-diameter surface which connects the second portion and the shell surface to each other. The connecting portion having such a configuration is superior especially in strength, and has an advantage that the withstand voltage of the insulator can be improved.

Also, in the connecting portion, the reduced-diameter surface of the projecting surface is formed into a taper surface which is sloped upgrade toward the outside when the insulator is positioned upright with the first portion down. With this arrangement, the angle formed by the second portion of the through hole and the reduced-diameter portion becomes an obtuse angle, preventing or suppressing the notch effect at their connecting portion, and thus giving an advantage that the strength of the insulator is improved. In this case, the aforementioned protruding-portion receiving surface is also desirably a similar taper surface.

Next, in order to solve the third object of the present invention, as a third constitution of the spark plug of the present invention, an insulator is placed inside a cylindrical metal shell;

to a through hole formed along an axial direction of the insulator, a terminal is inserted and fixed on one end side of the through hole while a center electrode is inserted and fixed on the other end side of the through hole;

an electrically conductive coupling portion is formed in the through hole between the terminal and the center electrode, the electrically conductive coupling portion comprising electrically conductive glass seal portions and serving for connecting the terminal and the center electrode to each other;

an axially extending through hole is formed in the insulator, where a portion of the through hole located on the front side of a tapered protruding-portion receiving surface is formed into a first portion of a smaller diameter, while a portion of the through hole located on the rear side of the protruding-portion receiving surface is formed into a second portion of a larger diameter;

the center electrode has, in the through hole, a bar-shaped center-electrode body portion which is inserted into the first portion and an electrode-fixing protruding portion which is formed at a rear end portion of the center-electrode body portion so as to be protruded outward from an outer circumferential surface of the center-electrode body portion and which is engaged with the protruding-portion receiving surface; and a taper angle of the protruding-portion receiving surface is set to 45°–85° as an angle viewed from a reference plane perpendicular to a center axis line of the through hole.

With this constitution, because the taper angle of the protruding-portion receiving surface is set relatively large, the flow resistance of the electrically conductive glass seal portion at the inner wall of the through hole in the vicinity of the protruding-portion receiving surface can be suppressed low so that a sufficient fluidity can be ensured. As a result, pressure propagation at the time of heating and sealing is not impaired, so that the vitrifiability in minute spaces (seal portions) present between the taper surface of the electrode-fixing protruding portion and the taper surface of the protruding-portion receiving surface can be improved, and moreover that thermal conductivity can be improved. Thus, the thermal resistance performance (anti-preignition performance) of the spark plug can be improved. Further, because the compactness of the seal portion can be made uniform, the thermal resistance performance (anti-preignition performance) of the spark plugs becomes generally uniform from product to product.

The numerical-value limitation for the taper angle of the protruding-portion receiving surface is due to the following reasons.

If the taper angle of the protruding-portion receiving surface is less than 45°, then it may be difficult to make the electrically conductive glass powder layer go around and reach sufficiently to the electrode-fixing protruding portion in glass sealing, causing nonuniformities to occur to the compactness of the seal positions. Also, if the taper angle of the protruding-portion receiving surface exceeds 85°, then it would be impossible to receive the electrode-fixing protruding-portion of the center electrode by the protruding-portion receiving surface when hot press pressure is applied in the sealing process. Besides, it may become difficult to set the tip end position of the center electrode within specified dimensions, due to slight dimensional or angular errors. In addition, the taper angle is desirably 60°–85°, and more desirably 75°–85°.

In this case, the spark plug may be so constituted that:

the electrically conductive coupling portion comprises a first electrically conductive glass seal portion, a resistor and a second electrically conductive glass seal portion which are formed in this order from the terminal side in the through hole;

the terminal is inserted into the through hole so that a terminal portion is protruded from a rear end face of the insulator, and a tip end portion of the terminal is sealed in the through hole by the first electrically conductive glass seal portion; and that the electrode-fixing protruding portion is sealed within the through hole by the second electrically conductive glass seal portion. With this constitution, because the terminal portion of the terminal is projected from the rear end face of the insulator, there is no need of using any special jigs or the like in the glass sealing work. Thus, the work is facilitated and the man-hour for work can be reduced.

Desirably, the taper angle of a tapered connecting portion between the electrode-fixing protruding portion and the center-electrode body portion, with which the protruding-portion receiving surface makes contact, is set to not more than (θ+5)° where the taper angle of the protruding-portion receiving surface is θ°. With this arrangement, in the glass sealing process, the electrically conductive glass powder layer becomes more likely to go around and reach the electrode-fixing protruding portion so that variations in the compactness of the seal portion can be prevented.

For example, as shown in FIG. 17, when the taper angle of the connecting portion of the electrode-fixing protruding portion of the center electrode is set larger than the taper angle of the protruding-portion receiving surface, a minute space is formed between the taper surface of the connecting portion of the electrode-fixing protruding portion of the center electrode and the taper surface of the protruding-portion receiving surface. It is difficult to make the electrically conductive glass powder layer sufficiently flow to this minute space during the glass sealing process. If this minute space is small, there would occur less problems, but with increasing size of this minute space, the stability of the center electrode becomes more likely to be lost, causing variations in the compactness of the seal portion to occur.

Also, for example as shown in FIG. 18, when the taper angle of the connecting portion of the electrode-fixing protruding portion of the center electrode is set smaller than the taper angle of the protruding-portion receiving surface, there is no need of making the electrically conductive glass powder layer flow to the minute space between the taper surface of the connecting portion of the electrode-fixing protruding portion of the center electrode and the taper surface of the protruding-portion receiving surface. That is, the electrically conductive glass powder layer can easily be made to flow to the outer circumferential surface of the electrode-fixing protruding portion of the center electrode, and the stability of the center electrode can be ensured only by making the electrically conductive glass powder layer flow to this portion and moreover the compactness of the seal portion can be made uniform. Therefore, it is desirable that the taper angle of the connecting portion of the electrode-fixing protruding portion of the center electrode is set to not more than (θ+5)°.

In this connection, while the spark plug is mounted to an engine and kept running, most of the heat that the spark plug receives will escape to the insulator from the connecting portion via the center electrode. Accordingly, the thermal resistance performance can be further stabilized by increasing the contact area of the connecting portion and the protruding-portion receiving surface. Also, because the force with which the center electrode is pushed out toward the igniter side is received by this portion, the center electrode can be prevented from coming out excessively (which means that the tip end position of the center electrode goes beyond the specified dimension) due to the increase in the contact area. To increase the contact area of the connecting portion and the protruding-portion receiving surface, it is desirable that the taper angle of the connecting portion of the electrode-fixing protruding portion of the center electrode is set within a range of −5° to +5° from the taper angle of the protruding-portion receiving surface.

BRIEF DESCRIPTION OF THE DRAWINGS

FIG. 15 is an explanatory view showing the relationship between the taper angle at connecting portion and the impact resistance;

DETAILED DESCRIPTION OF THE PREFERRED EMBODIMENTS

Hereinbelow, an embodiment of the present invention is described with reference to some examples as illustrated in the accompanying drawings.

EXAMPLE 1

Figure 1:
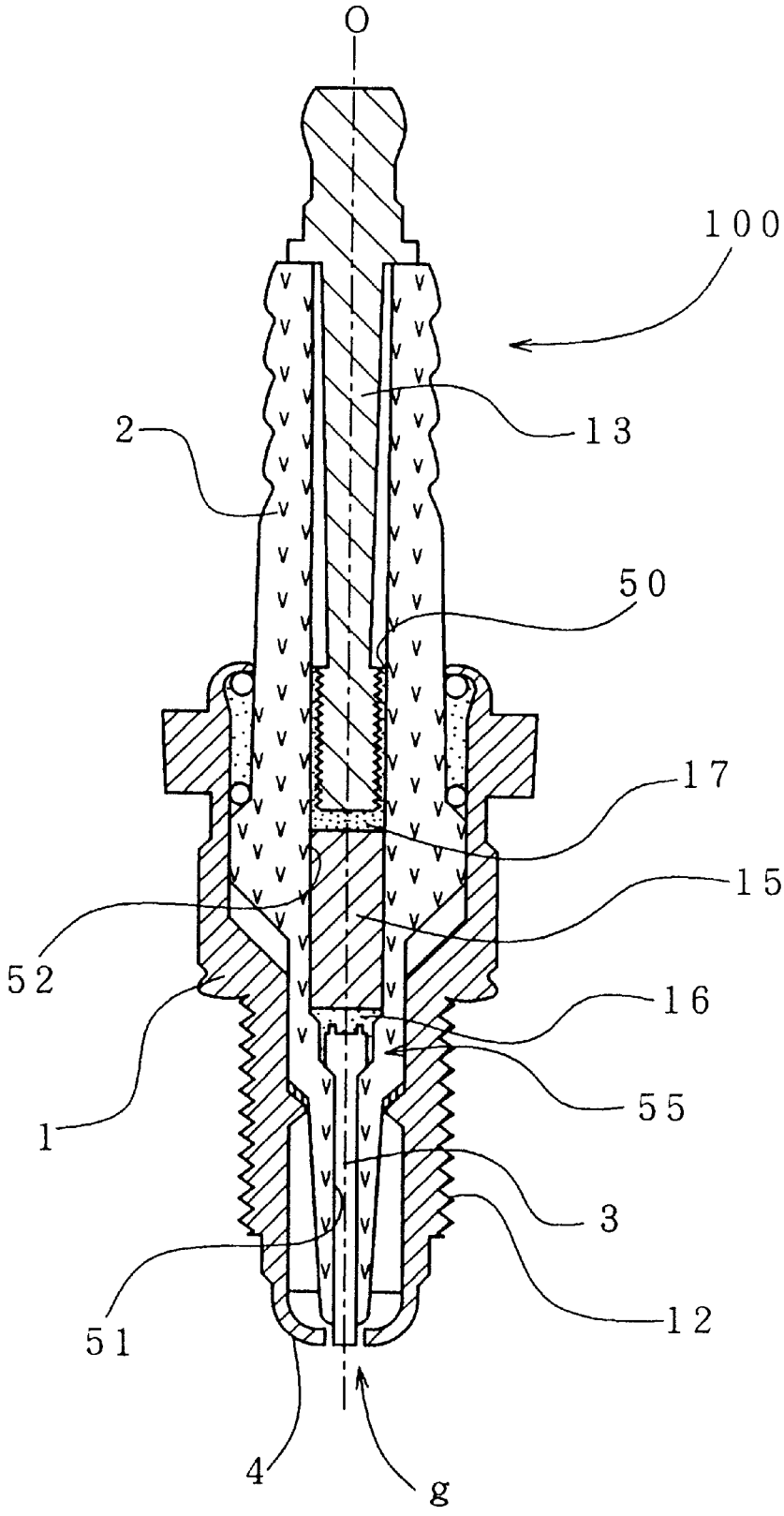
FIG. 1 is a longitudinal sectional view showing an example of a spark plug according to Example 1 of the present invention.

FIG. 1 shows an example of the spark plug according to the first and second constitutions of the present invention. That is, a spark plug 100 comprises a cylindrical metal shell 1, an insulator 2 fitted to the metal shell 1 so that its tip end portion is projected, a center electrode 3 provided inside the insulator 2, a ground electrode 4 one end of which is coupled to the metal shell 1 and which is so placed as to be opposed to the center electrode 3, and the like, where a gap g is provided between the ground electrode 4 and the center electrode 3. On the other hand, the base end side of the ground electrode 4 is fixed and integrated to the metal shell 1 by welding or the like. The metal shell 1 is made from carbon steel or the like, and a threaded portion 12 for mounting to the combustion engine is formed on its outer circumferential surface as shown in FIG. 1. Also, the center electrode 3 is made from Ni alloy or the like, further, the insulator 2 is formed from a ceramic sintered body such as alumina.

A through hole 50 is formed axially in the insulator 2, where a terminal 13 is inserted and fixed to one end side of the through hole 50 while the center electrode 3 is inserted and fixed to the other end side of the through hole 50 likewise. Also, within the through hole 50, a resistor 15 is placed between the terminal 13 and the center electrode 3. Both end portions of this resistor 15 are electrically connected to the center electrode 3 and the terminal 13 via conductive glass seal portions 16, 17, respectively. The resistor 15 is formed from a resistor composition which is obtained by mixing a glass powder and a conductive material powder (and, as required, a ceramic powder other than glass) and sintering the mixture with a hot press or the like. The conductive glass seal portions 16, 17 are formed from a glass mixed with a metal powder of Cu, Fe (or their alloys) and the like.

Next, the stem cross-section diameter of the center electrode 3 is set smaller than the stem cross-section diameter of the resistor 15. Here assuming that one side toward the tip end of the center electrode 3 is regarded as the front side, the through hole 50 of the insulator 2 has a first portion 51 which allows the center electrode 3 to be inserted therethrough, and a second portion 52 which is formed on the rear side (upper side in the figure) of the first portion 51 so as to be larger in diameter than the first portion 51 and which accommodates therein the resistor 15. Then, the second portion 52 is connected to the first portion 51 via a connecting portion 55 including a reduced-diameter portion of two steps, and at a position corresponding to the connecting portion 55, the conductive glass seal portion 16 is placed between the resistor 15 and the center electrode 3.

Figure 2:
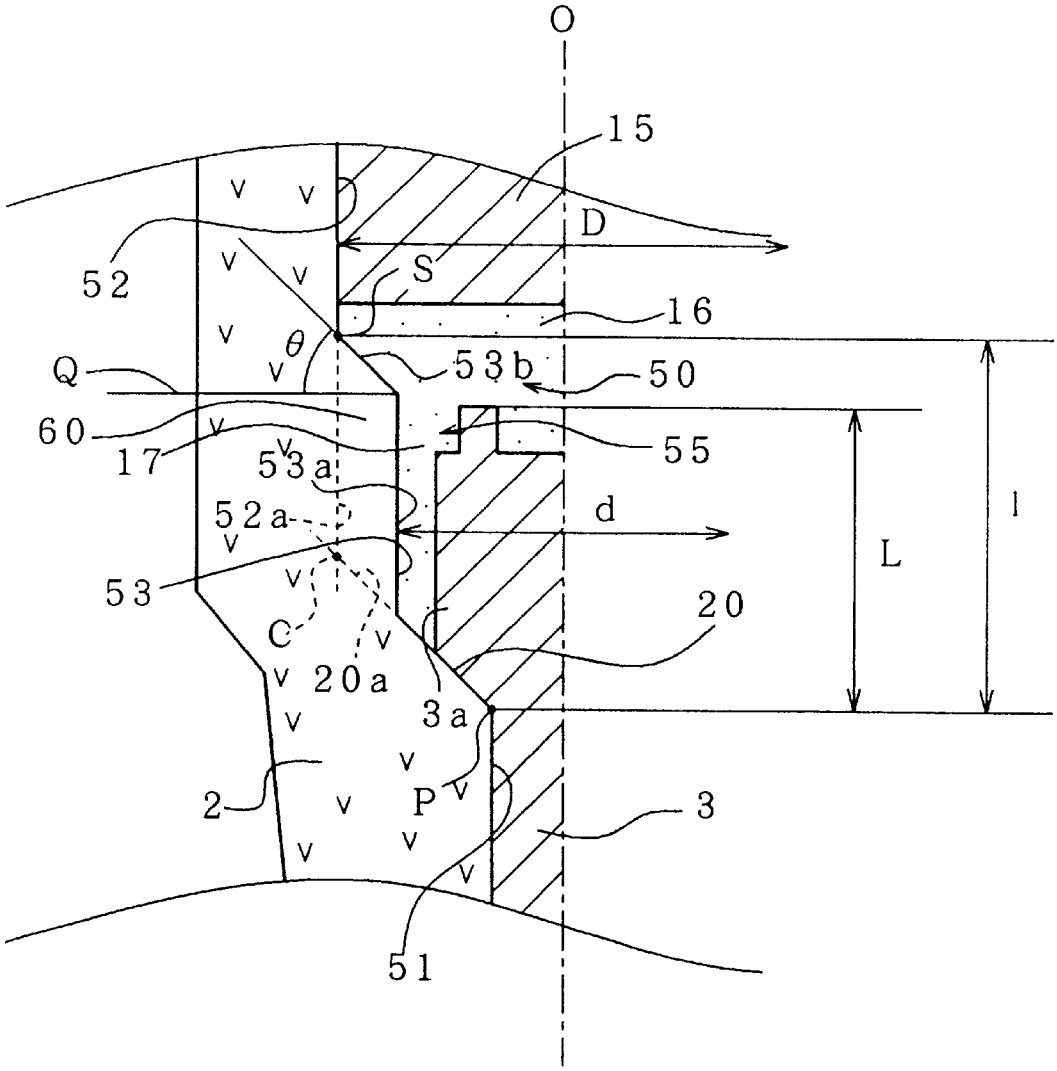
FIG. 2 is a front sectional view showing main part of the spark plug.

FIG. 2 is a main-part sectional view of near the connecting portion 55 by a plane containing a center axis line O of the insulator 2. That is, on a rear end portion of the center electrode 3, an electrode-fixing protruding portion 3*a* is formed so as to be projected outward from the outer circumferential surface of the center electrode 3. Then, at the connecting portion 55 of the through hole 50, a protruding-portion receiving surface 20 for receiving the electrode-fixing protruding portion 3*a* is formed in such a shape as to be adjacent to the rear end edge of the first portion 51 and be projected outward from the inner circumferential surface of the first portion 51. Also in the connecting portion 55, a projecting portion 60 is formed in correspondence to a crossing portion between an outward extended surface 20*a* of the protruding-portion receiving surface 20 and an extended surface 52*a* of the second portion 52 toward the protruding-portion receiving surface 20, so that the projecting portion 60 stretches over these two extended surfaces 20*a*, 52*a*, where the surface of the projecting portion 60 is given as a projecting surface 53.

In the spark plug 100, if the length in the direction of the center axis line from a connecting point P between the protruding-portion receiving surface 20 and the first portion 51 to a connecting point S between the projecting surface 53 and the second portion 52 is l, and if the length in the direction of the center axis line from the connecting point P to the rear end edge of the center electrode 3 is L, then the value of l/L is set to not less than 0.5 (desirably, not less than 1.0).

Next, the inner circumferential surface of the second portion 52 of the through hole 50 is formed into a generally cylindrical surface. Besides, minute tapers may also be added with an aim of allowing an easier removal of molding pins during molding process or other purposes. The angle of these tapers, as an angle formed with the center axis line o, is about 1–1.2°. Also, the projecting surface 53 of the connecting portion 55 has a generally cylindrical shell surface 53*a* connected to the protruding-portion receiving surface 20 and placed concentrically with the second portion of through hole 52, and a reduced-diameter surface 53*b* for connecting the shell surface 53*a* and the second portion 52 to each other. In this connection, let the inner diameter of the second portion 52 be D, and the inner diameter of the shell surface 53*a* be d, then the value of d/D is adjusted within a range of 0.5–0.95 (desirably, 0.75–0.8).

Also, the reduced-diameter surface 53*b* of the projecting surface 53 is formed into a taper surface which is sloped upward toward the outside when the insulator 2 is positioned upright with the first portion 51 down. Then, assuming that a plane perpendicular to the center axis line O of the insulator 2 (through hole 50) is taken as a reference plane Q, the slope angle θ of the taper surface to the reference plane Q is adjusted within a range of 20–80° (desirably 30–50°). In the connecting portion 55, this reduced-diameter surface 53*b* constitutes a first-step reduced-diameter portion, and the protruding-portion receiving surface 20 constitutes a second-step reduced-diameter portion.

Figures 7A, 7B, 7C, 7D:
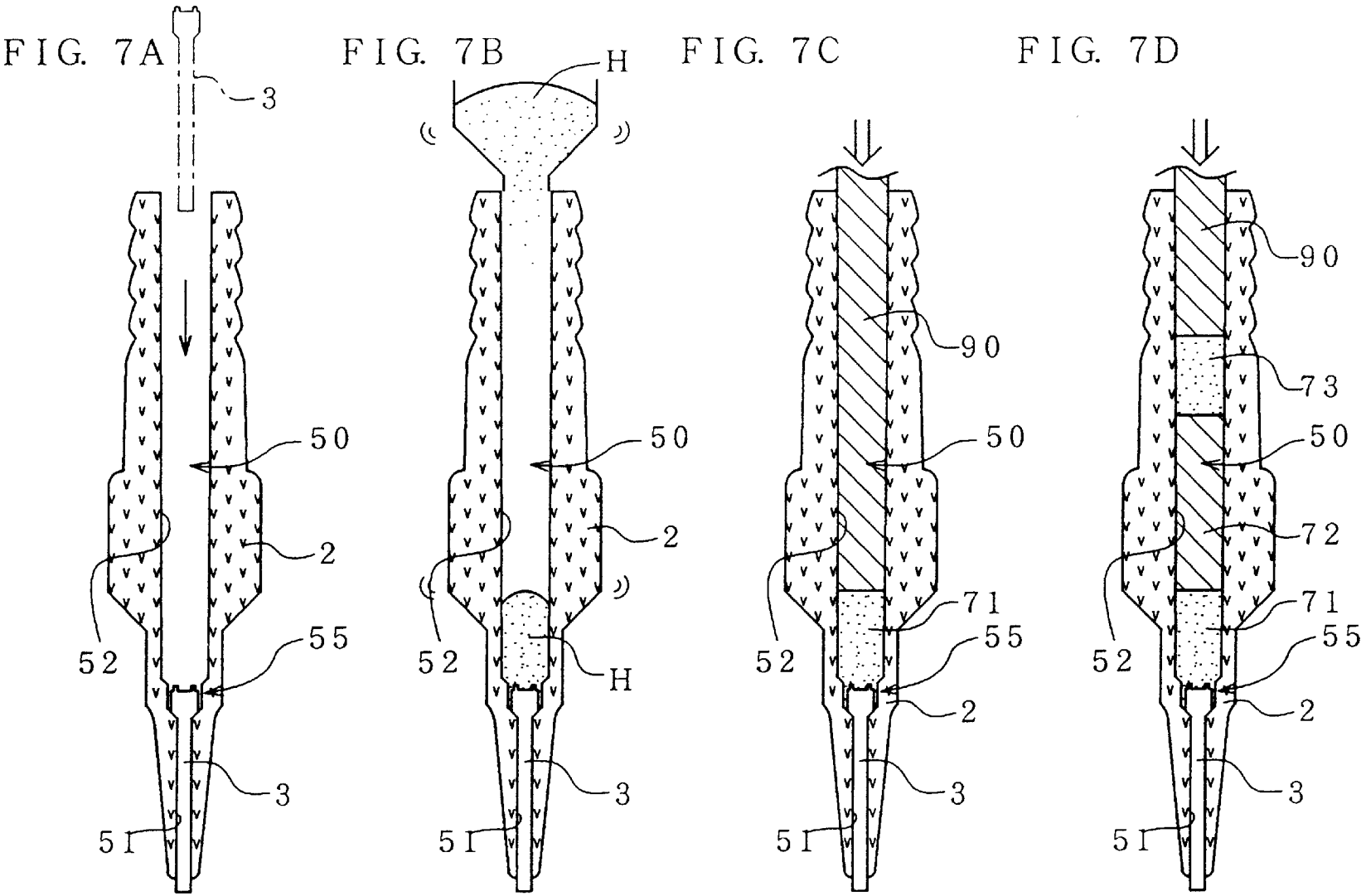
FIG. 7A is an explanatory view showing manufacturing process for the spark plug of FIG. 1.
FIG. 7B is an explanatory view subsequent to FIG. 7A.
FIG. 7C is an explanatory view subsequent to FIG. 7B.
FIG. 7D is an explanatory view subsequent to FIG. 7C.

With respect to this spark plug 100, the assembly of the center electrode 3 and the terminal 13 to the insulator 2, as well as the formation of the resistor 15 and the conductive glass seal portions 16, 17 can be achieved in the following way. First, as shown in FIG. 7A, with respect to the through hole 50 of the insulator 2, the center electrode 3 is inserted into its first portion 51 and then, as shown in FIG. 7B, conductive glass powder H is filled thereinto. Then, as shown in FIG. 7C, a presser bar 90 is inserted into the through hole 50 and the filled powder H is pressed, by which a first conductive glass powder layer 71 is formed. Subsequently, material powder of the resistor composition is filled thereinto, pressed similarly, and with conductive glass powder further filled, the resulting product is pressed. As a result, as shown in FIG. 7D, in the through hole 50, the first conductive glass powder layer 71, a resistor-composition powder layer 72 and a second conductive glass powder layer 73 are stacked one on another, as viewed from the center electrode 3 side (from below).

Figure 8A:
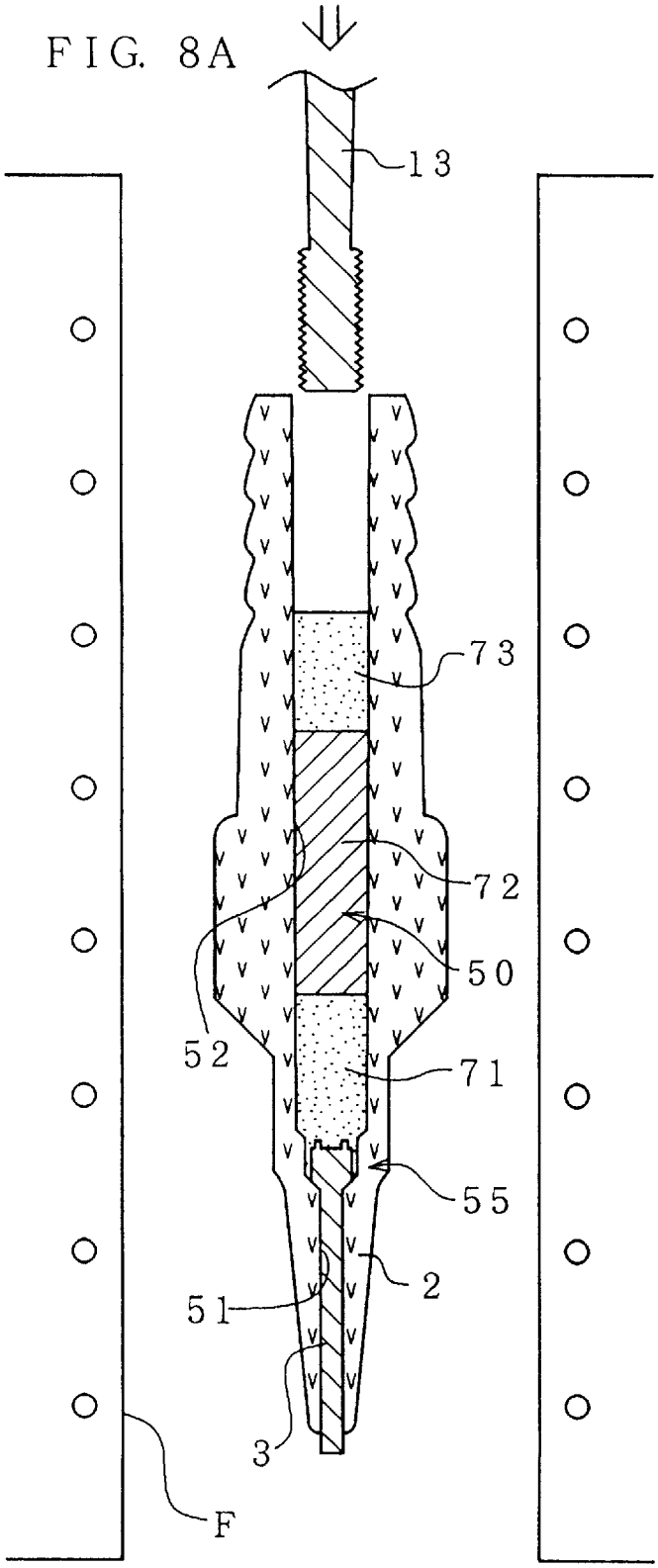
FIG. 8A is an explanatory view subsequent to FIG. 7D.
Figure 8B:
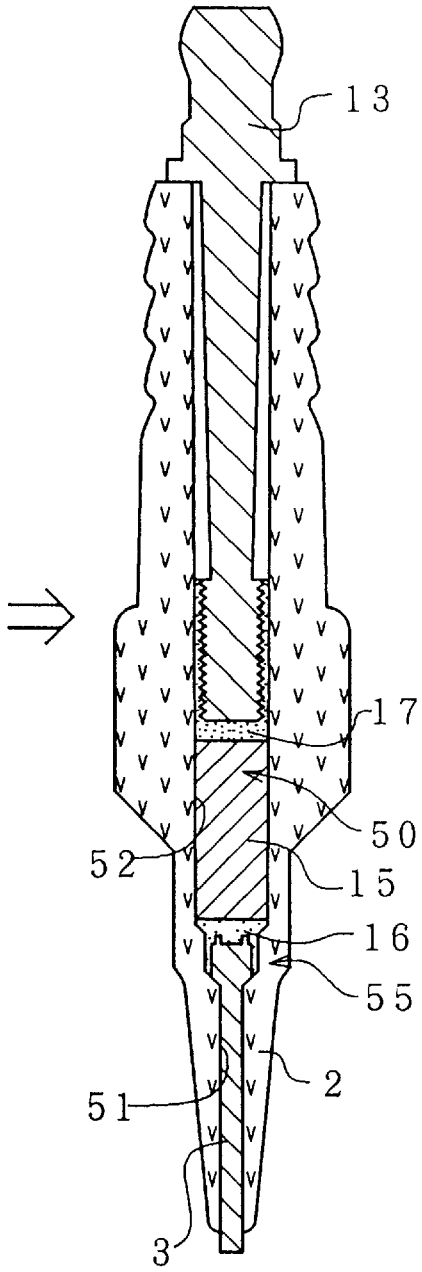
FIG. 8B is an explanatory view subsequent to FIG. 8A.

Subsequently, as shown in FIG. 8A, the whole product is inserted into a kiln F as it is, where it is heated to a temperature of 900–1000° C., which is higher than the glass softening point. Afterwards, the terminal 13 is press fitted into the through hole 50 from a side opposite to the center electrode 3 so that the layers 71 to 73 in the stacked state are pressed axially. As a result, as shown in FIG. 8B, the individual layers are compressed and sintered, forming the conductive glass seal portion 16, the resistor 15 and the conductive glass seal portion 17, respectively.

Figure 11A:
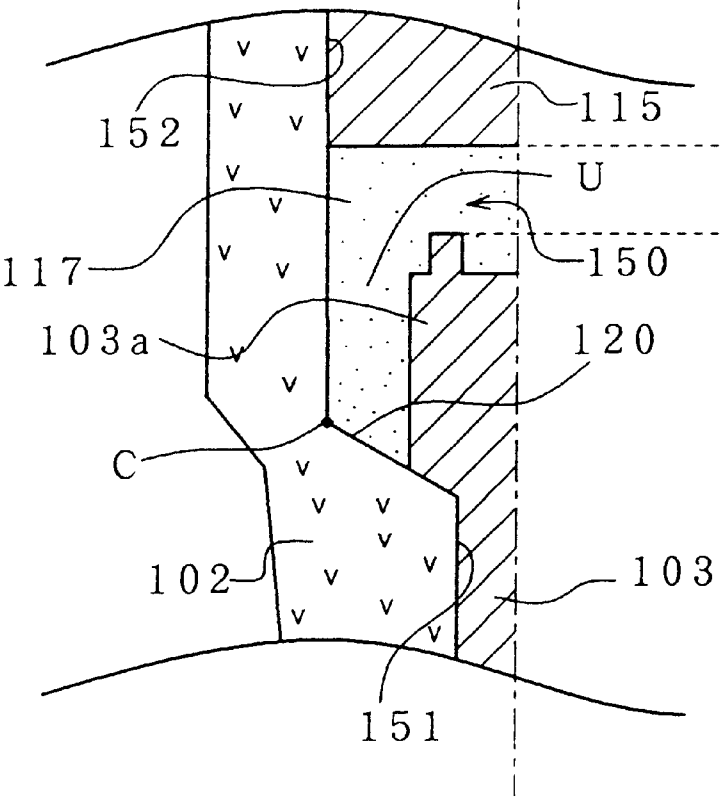
FIG. 11A Prior Art
FIG. 11A is an explanatory view showing a spark plug according to the prior art.

Now, advantages of the spark plug 100 of the present invention are explained in comparison with the prior art. First, in the prior art spark plug, as shown in FIG. 11A, in the formation of a second portion 152 and a first portion 151 in a through hole 150 of an insulator 102, these portions would generally be connected by a one-step taper surface (protruding-portion receiving surface) 120 so as to make this taper surface 120 supporting an electrode-fixing protruding portion 103*a* of a center electrode 103. Unfortunately, when the connecting portion is formed into the one-step taper surface 120 like this, there would be formed quite a wide space U between the side face of the electrode-fixing protruding portion 103*a* and the second portion 152. Therefore, when the pressing force is reduced by the friction between the upper layers 72, 73 (FIG. 7D) and the wall surface of the through hole 50 in the above manufacturing process, the compressing force for the conductive glass powder is more likely to be insufficient so that successful joint state could not be obtained in some cases.

Figure 9:
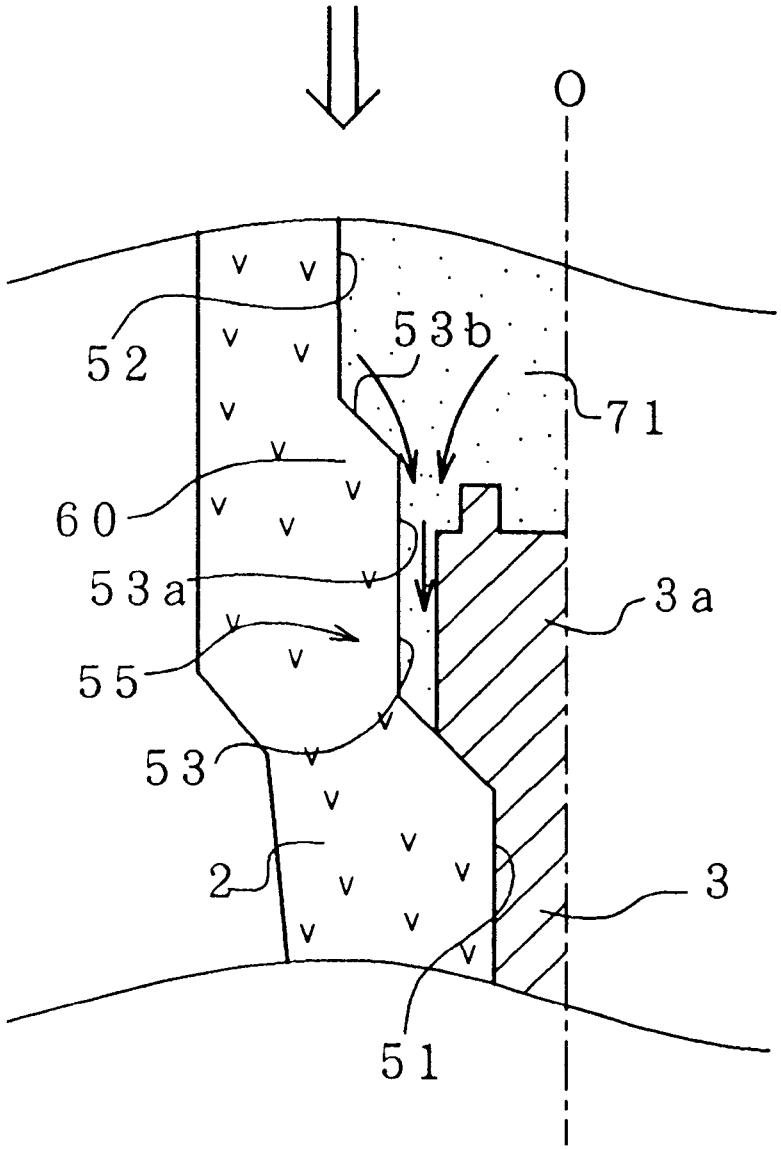
FIG. 9 is an action explanatory view of the projecting portion of the spark plug of FIG. 1.

However, in the spark plug 100 of the present invention, as shown in FIG. 2, there are provided a protruding-portion receiving surface 20, as well as a projecting portion 60 (projecting surface 53) formed in correspondence to a crossing portion between the outward extended surface 20*a* of the protruding-portion receiving surface 20 and an extended surface 52*a* of the second portion 52 toward the protruding-portion receiving surface 20 so that the projecting portion 60 stretches over these two extended surfaces 20*a*, 52*a*. As a result, as shown in FIG. 9, the spatial volume between the side face of the electrode-fixing protruding portion 3*a* and the second portion 52 and moreover the axial pressurizing cross-sectional area of the first conductive glass powder layer 71 (FIG. 7C, FIG. 7D) filled into the space are reduced, so that a sufficient compressing force can be ensured even when the pressing force is reduced by the friction. Consequently, the conductive glass powder that has been semi-melted by heating comes to well flow into narrow gaps between the electrode-fixing protruding portion 3*a* of the center electrode 3 and the projecting portion 60 and the like. As a result of this, the sintering of the glass seal portion progresses sufficiently so that the burns of carbon in the glass seal portion and the oxidization of metal components become unlikely to occur. Thus, a conducting state via the glass seal portion 16 can be ensured between the resistor 15 and the center electrode 3 in FIG. 1 with ease and in a successful state.

Figure 11B:
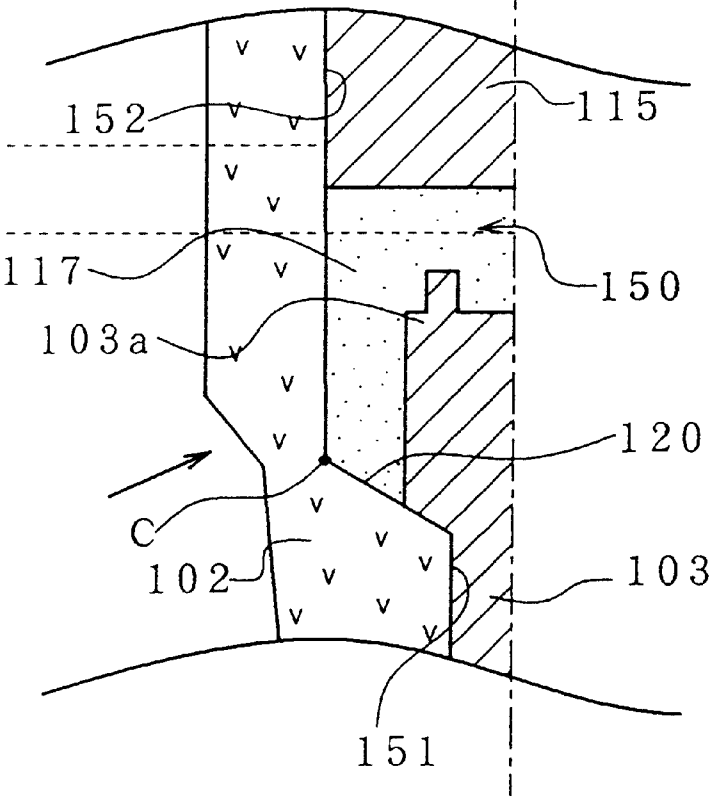
FIG. 11B Prior Art
FIG. 11B is an explanatory view showing problems of the same.

Reverting to FIG. 2, providing the protruding portion in the connecting portion 55 allows the following effects to be achieved. That is, the radio frequency noise prevention effect in the spark plug generally tends to improve as the length of the resistor increases. However, it is not allowed to freely change the outside dimensions of the insulator because of specifications of the spark plug, while there is a limitation in increasing the length of the resistor as far as the outside dimensions of the insulator are maintained unchanged. For example, it could be conceived that, as shown in FIG. 11B, the position of the protruding-portion receiving surface 120 is moved toward the tip end of the center electrode 103, making the second portion 152 of the through hole 150 extended in its axial length and thereby causing the length of the resistor 115 proportionally. However, this method has a disadvantage that the insulator 102 is thinned in wall thickness at a position corresponding to the protruding-portion receiving surface 120 as shown in FIG. 11B so that the strength of this portion is likely to lack. In this case, in particular, the crossing portion C between the protruding-portion receiving surface 120 and the second portion 152 may serve as a kind of notch, which often causes problems in terms of strength.

However, with the above constitution, as shown in FIG. 2, even if the position of the protruding-portion receiving surface 20 is changed to extend the axial length of the second portion 52, the projecting portion 60 is formed so as to stretch the extended surfaces 20*a*, 52*a* of the protruding-portion receiving surface 20 and the second portion 52, thus preventing the insulator 2 from being thinned in wall thickness as mentioned above. Further, because the crossing portion C of the extended surfaces 20*a*, 52*a* is buried in the projecting portion 60, the notch effect does not occur. As a result, the length of the resistor 15 can be increased while a sufficient strength of the insulator 2 is ensured, so that a spark plug superior in radio frequency noise preventing performance can be realized.

Figure 10A:
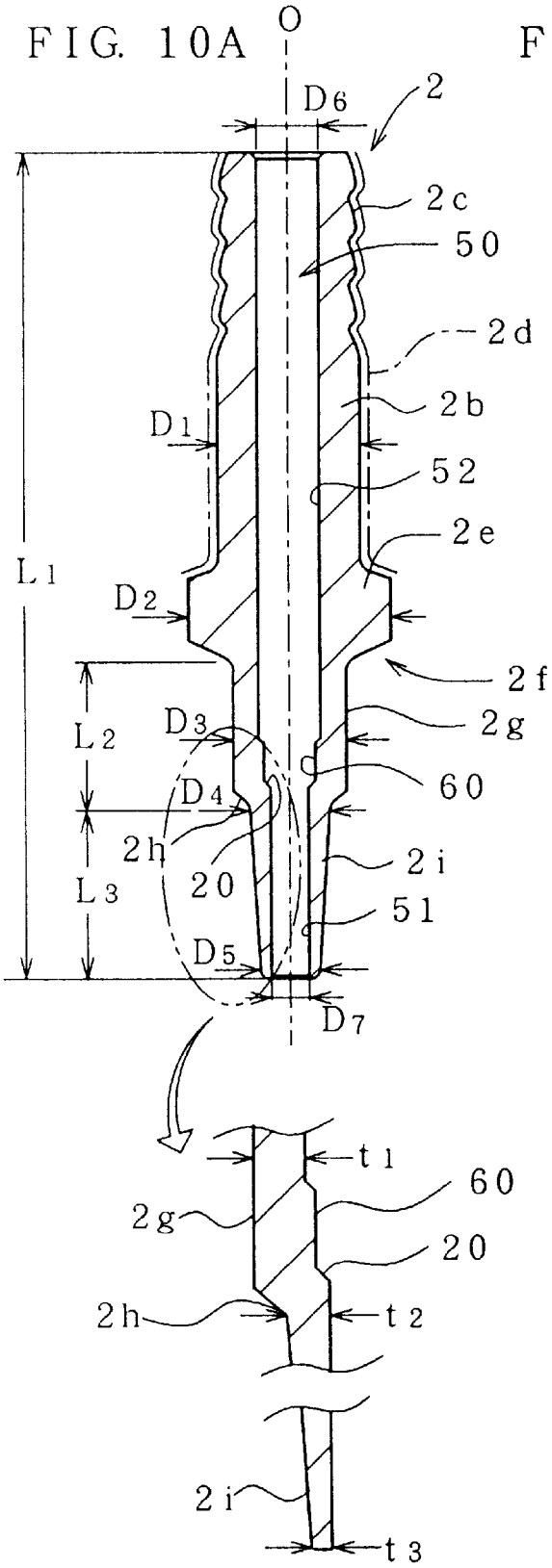
FIG. 10A is a front sectional view showing another example of the insulator.
Figure 10B:
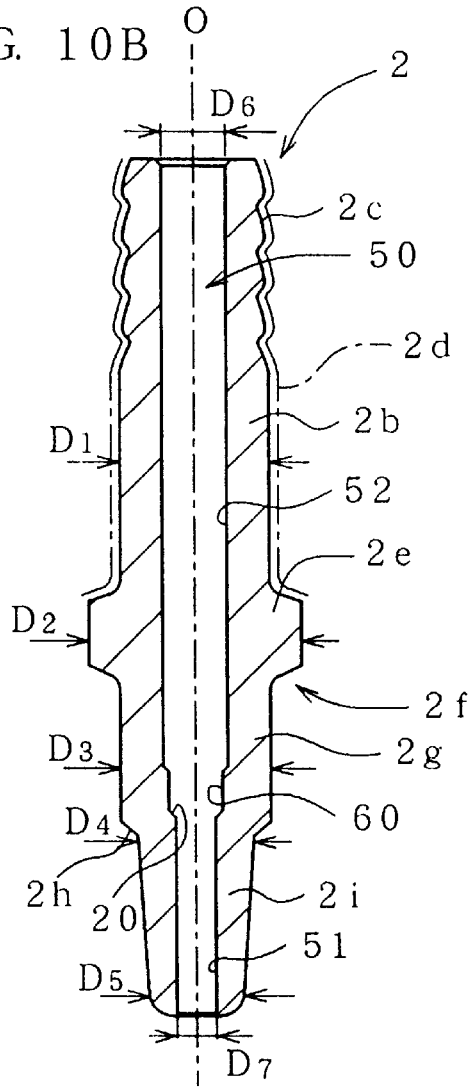
FIG. 10B is a front sectional view showing yet another example of the same.

In addition, FIGS. 10A, 10B show another example of the insulator 2. An engagement protruding portion 2*e* is formed, for example in a flange shape, at an axial intermediate portion of the insulator 2 shown in FIG. 10A. Then, in the insulator 2, assuming that one side toward the tip end of the center electrode 3 (FIG. 1) is regarded as the front side, the rear side of the insulator 2 over the engagement protruding portion 2*e* is a body portion 2*b* formed so as to be thinner in diameter than the front side. On the other hand, on the front side of the engagement protruding portion 2*e*, a first stem portion 2*g* thinner than the engagement protruding portion 2*e* and a second stem portion 2*i* even thinner than the first stem portion 2*g* are formed in this order. In addition, glaze 2*d* is applied on the outer circumferential surface of the body portion 2*b*, while a corrugation 2*c* is formed at the rear end portion of the outer circumferential surface. Also, the outer circumferential surface of the first stem portion 2*g* is formed into a generally cylindrical shape, and the outer circumferential surface of the second stem portion 2*i* is formed into such a generally conical surface that has been reduced in diameter with increasing proximity to the tip end.

The through hole 50 of the insulator 2 has a generally cylindrical first portion 51 which allows the center electrode 3 to be inserted therethrough, and a generally cylindrical second portion 52 which is formed on the rear side (upper side in the figure) of the first portion 51 so as to be larger in diameter than the first portion 51. Then, as in FIG. 1, the terminal and the resistor are accommodated in the second portion 52 while the center electrode is inserted into the first portion 51. The first portion 51 and the second portion 52 of the through hole 50 are connected to each other within the first stem portion 2*g* in FIG. 10A, and a protruding-portion receiving surface 20 and a projecting portion 60 are formed at their connecting position.

Dimensions of the above individual parts in an insulator 2 shown in FIG. 10A are, for example, as follows: L1=approx. 60 mm, L2=approx. 10 mm, L3=approx. 14 mm, D1=approx. 11 mm, D2=approx. 13 mm, D3=approx. 7.3 mm, D4=5.3 mm, D5=4.3 mm, D6=3.9 mm, D7=2.6 mm, t1=3.3 mm, t2=1.4 mm, t3=0.9 mm, tA=1.2 mm.

In another insulator 2 shown in FIG. 10B, the first stem portion 2*g* and the second stem portion 2*i* have outer diameters slightly larger than those of the insulator 2 shown in FIG. 10A. Dimensions of the individual parts are, for example, as follows: L1=approx. 60 mm, L2=approx. 10 mm, L3=approx. 14 mm, D1=approx. 11 mm, D2=approx. 13 mm, D3=approx. 9.2 mm, D4=6.9 mm, D5=5.1 mm, D6=3.9 mm, D7=2.7 mm, t1=3.3 mm, t2=2.1 mm, t3=1.2 mm, tA=1.7 mm.

Hereinbelow, modification examples of the above-described spark plug are explained.

Figure 3:
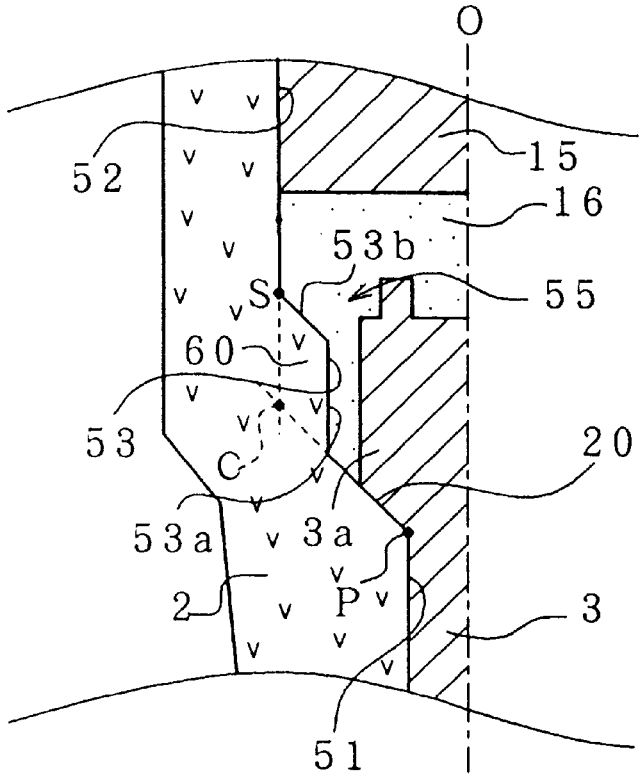
FIG. 3 is a main-part front sectional view showing a first modification of the spark plug according to the present invention.

First, the projecting portion 60 has been formed in FIG. 2 so that the connecting point S between the projecting surface 53 and the second portion 52 (i.e., a rear end edge position of the projecting portion 60) is positioned so as to be in the rear more than the rear end edge of the center electrode 3 in the direction of the center axis line O. However, as shown in FIG. 3, the projecting portion 60 may be formed so that the foregoing positional relation is reversed, within such a range that the value of 1/L is not less than 0.5.

Figure 4:
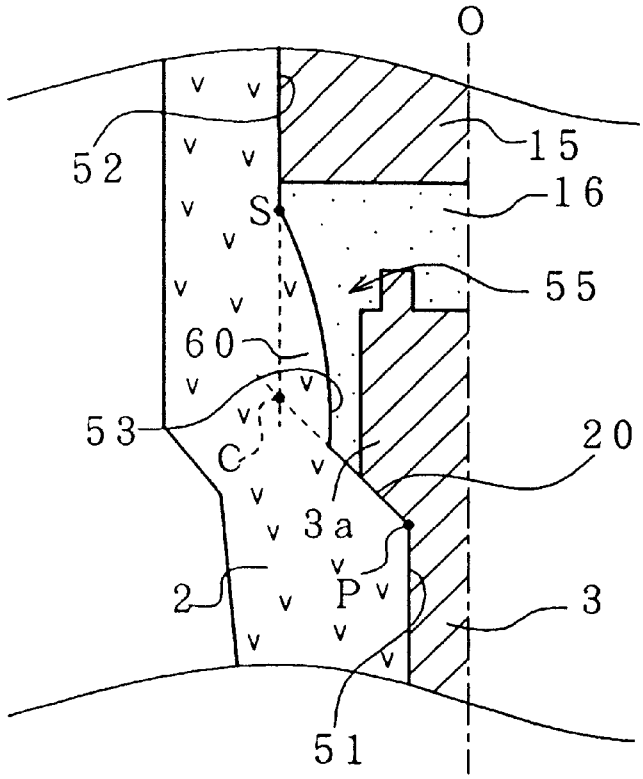
FIG. 4 is a main-part front sectional view showing a second modification of the same.
Figure 5A:
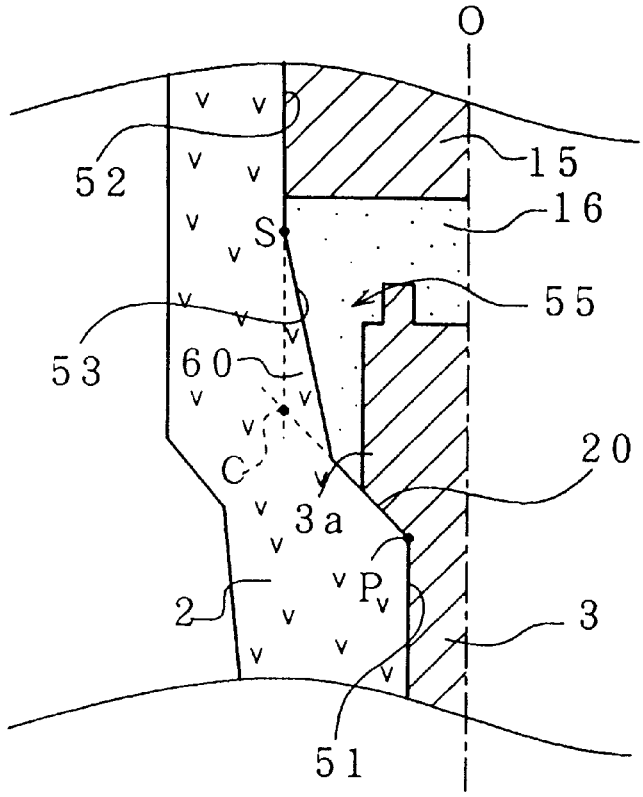
FIG. 5A is a main-part front sectional view showing a third modification of the same.
Figure 5B:
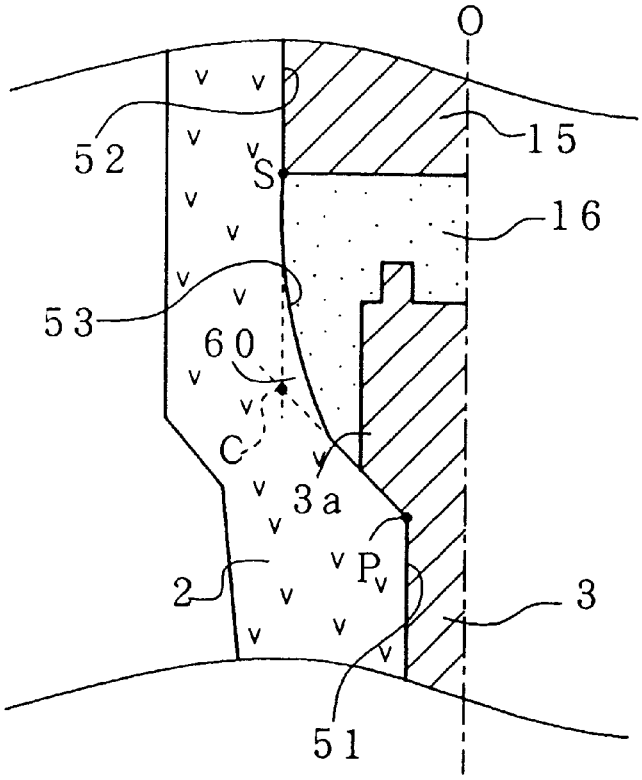
FIG. 5B is a main-part front sectional view showing a fourth modification of the same.
Figure 6:
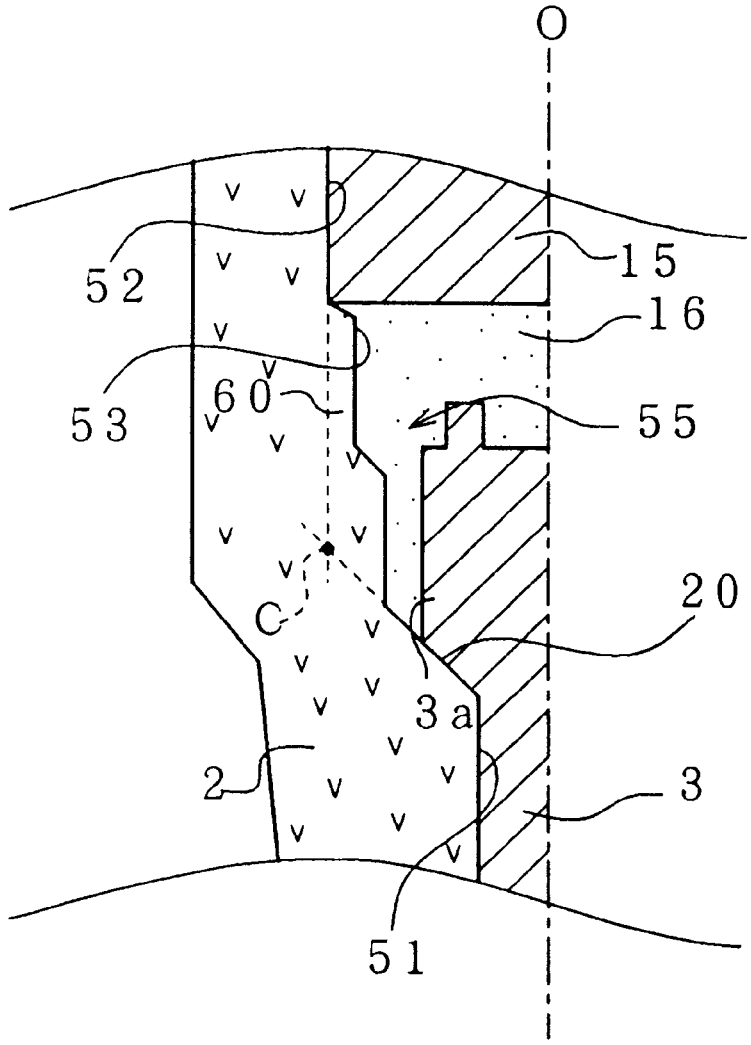
FIG. 6 is a main-part front sectional view showing a fifth modification of the same.

Also, the projecting surface 53 of the projecting portion 60 has been formed in FIG. 2 as a stopped surface comprising in combination a taper surface (reduced-diameter surface) 53*b* and an erectly cut shell surface 53*a*. However, the projecting surface 53 may also be formed so that the inner diameter of the through hole 50 is reduced continuously toward the direction from the connecting point S to the connecting point P, in such aspects of the outside line in cross section of the projecting surface 53 as a smooth convex curved line as shown in FIG. 4, a linear shape (taper surface) as shown in FIG. 5A, and moreover a concave curved line as shown in FIG. 5B. Besides, the connecting portion 55 may be formed so as to have three- or more-stepped reduced-diameter portions as shown in FIG. 6.

Now, in order to verify the effects of the spark plug of the above Example 1, the following experiments were conducted. First, spark plugs as shown in FIGS. 1 and 2, in which d, D, θ, l and L as described above were set to various values, were fabricated. Then, as an accelerated durability test, the spark plugs were increased in temperature to 350° C., and discharged for 300 hours according to the method defined in paragraph JISB8031: 6.10 so as to recover to normal temperature. After that, resistance values were measured, and rates of change from initial resistance values which had been measured before the start of the test were calculated, from which the resistance rates of change for spark durability were determined. These results are shown in Tables 1 and 2 attached to this specification.

Consequently, it can be understood that the spark plugs belonging to the scope of the present invention each showed a low resistance rate of change for spark durability, and that those having a value of l/L not less than 0.5, a value of d/D of 0.5–0.95, a value of θ of 20°–80° showed particularly successful results.

EXAMPLE 2

Figure 12:
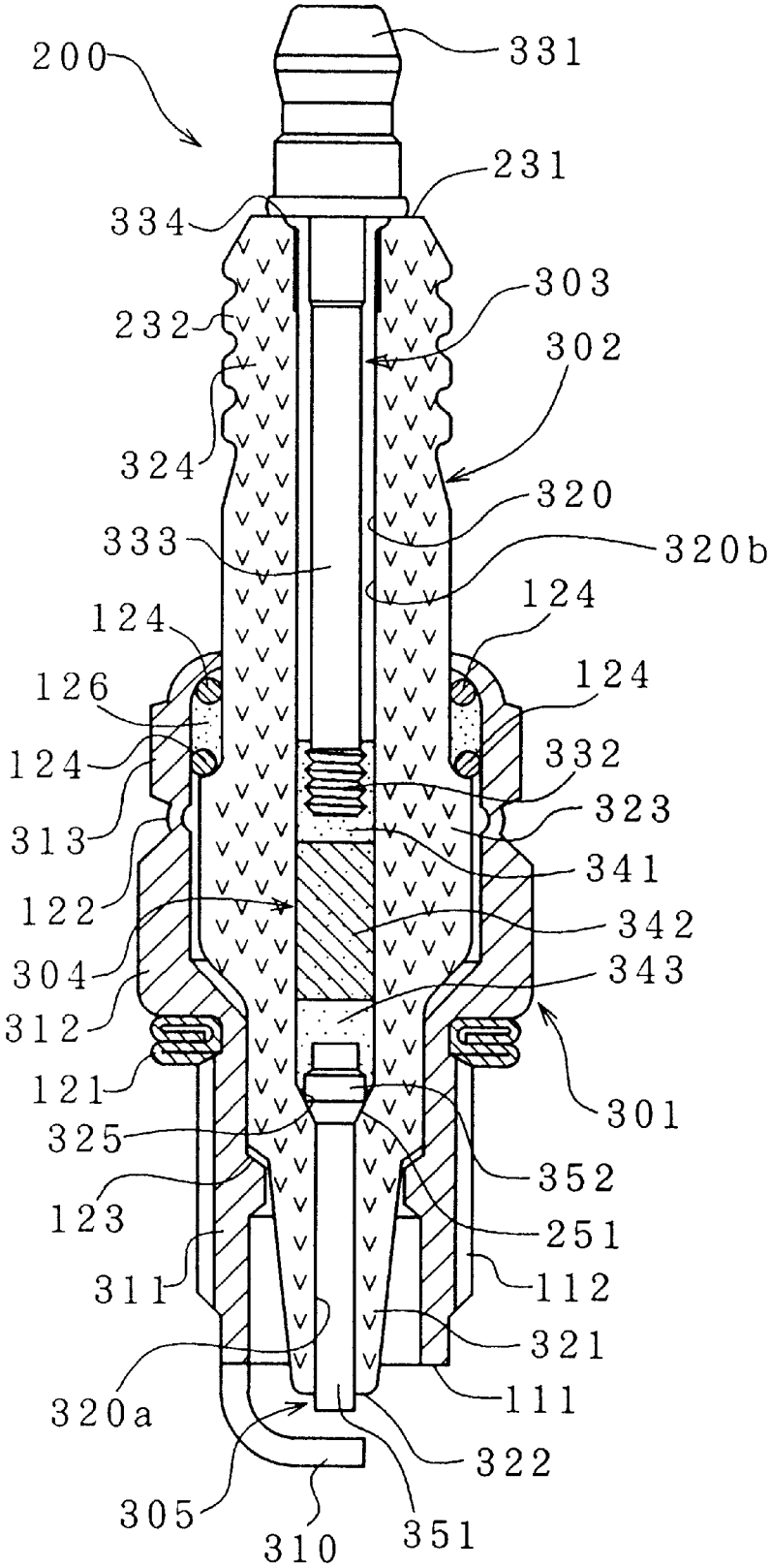
FIG. 12 is a longitudinal sectional view showing an example of a spark plug according to Example 2 of the present invention.
Figure 13:
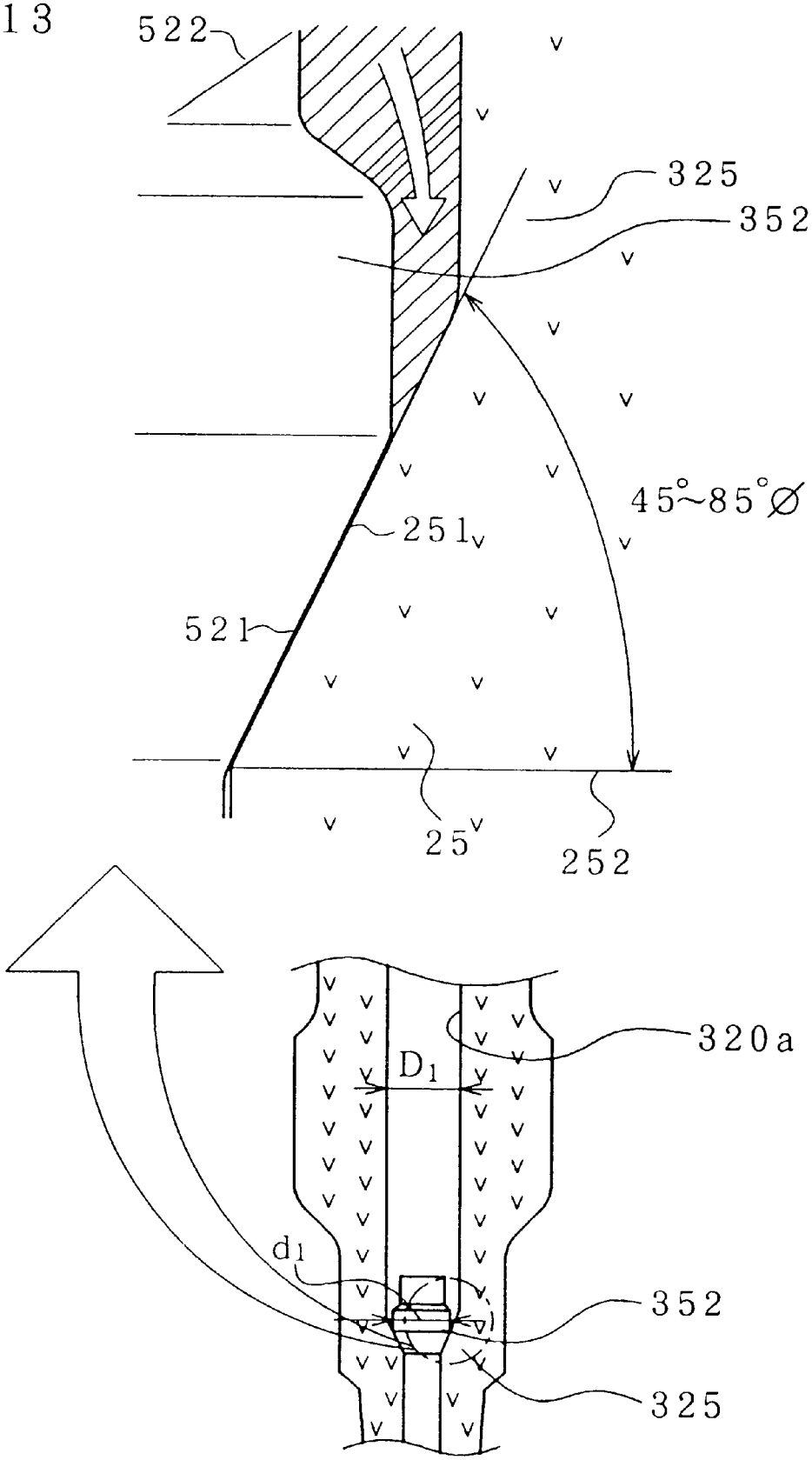
FIG. 13 is a main-part enlarged view of FIG. 1.

FIGS. 12 and 13 show an example of the spark plug according to the third constitution of the present invention. That is, a spark plug 200 comprises a cylindrical metal shell 301 having a ground electrode 310 protrusively provided on a tip end face 111, an insulator 302 with a through hole 320 which is fixed in the metal shell 301, a terminal 303 which has a terminal portion 331 protruded from a rear end face 231 of the insulator 302 and which is fitted into the through hole 320, a glass seal material 304 (electrically conductive coupling portion) which seals a tip end portion 332 of the terminal 303, and a center electrode 305 which is fixed in the through hole 320 so that a bar-shaped portion 351 is projected from a tip end face 322 of the insulator 302. Then, the spark plug 200 is screwed to a cylinder head of an internal combustion engine (not shown) via a gasket 121, and a plug cap (not shown) is fitted to the terminal portion 331, in which arrangement a high voltage is supplied to the spark plug 200.

The metal shell 301, which is formed from low carbon steel, comprises a threaded portion 311 having a thread 112 formed on the periphery, a trunk portion 312 having the gasket 121 provided on the front side and a thin-walled zone 122 circumferentially provided on the rear side, and a hexagonal portion 313 for allowing a plug wrench to be fitted thereto. In addition, reference numeral 123 denotes a packing and 124 denotes a ring.

The insulator 302, in which the through hole 320 has been formed along the axis, is formed from a ceramic sintered body composed mainly of alumina, and comprises a long-leg portion 321 located inside the threaded portion 311, a large-diameter portion located over a range from a hexagonal portion 313 of the metal shell 301 to the inside of the trunk portion 312, and a body portion 324 having a corrugation 232 formed on the outer periphery. Of the through hole 320, a portion which is located in the long-leg portion 321 on the front side of a tapered protruding-portion receiving surface 325 is taken as a first portion 320*a* of a smaller diameter (slightly larger than the center electrode diameter (ϕ2.6 mm)), while a portion which is located between the body portion 324 and a larger-diameter portion 323 and which is in the rear side of the protruding-portion receiving surface 325 is taken as a second portion of a larger diameter (ϕ4.2 mm).

Figure 14:
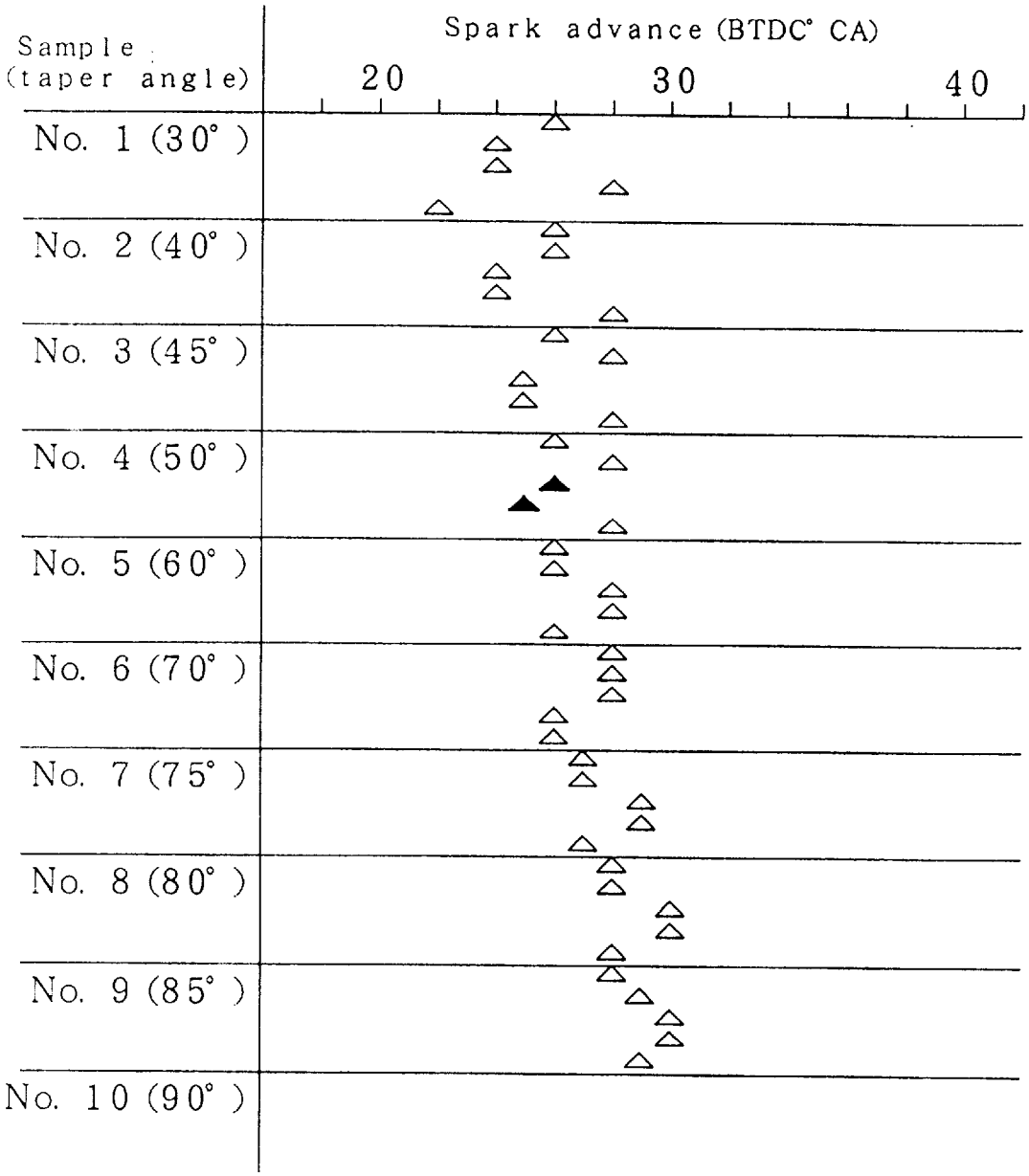
FIG. 14 is a graph showing the distribution of ignition timing advances at which preignitions occurred in spark plugs implemented by sample Nos. 1–9 (five pieces each)
Figure 16:
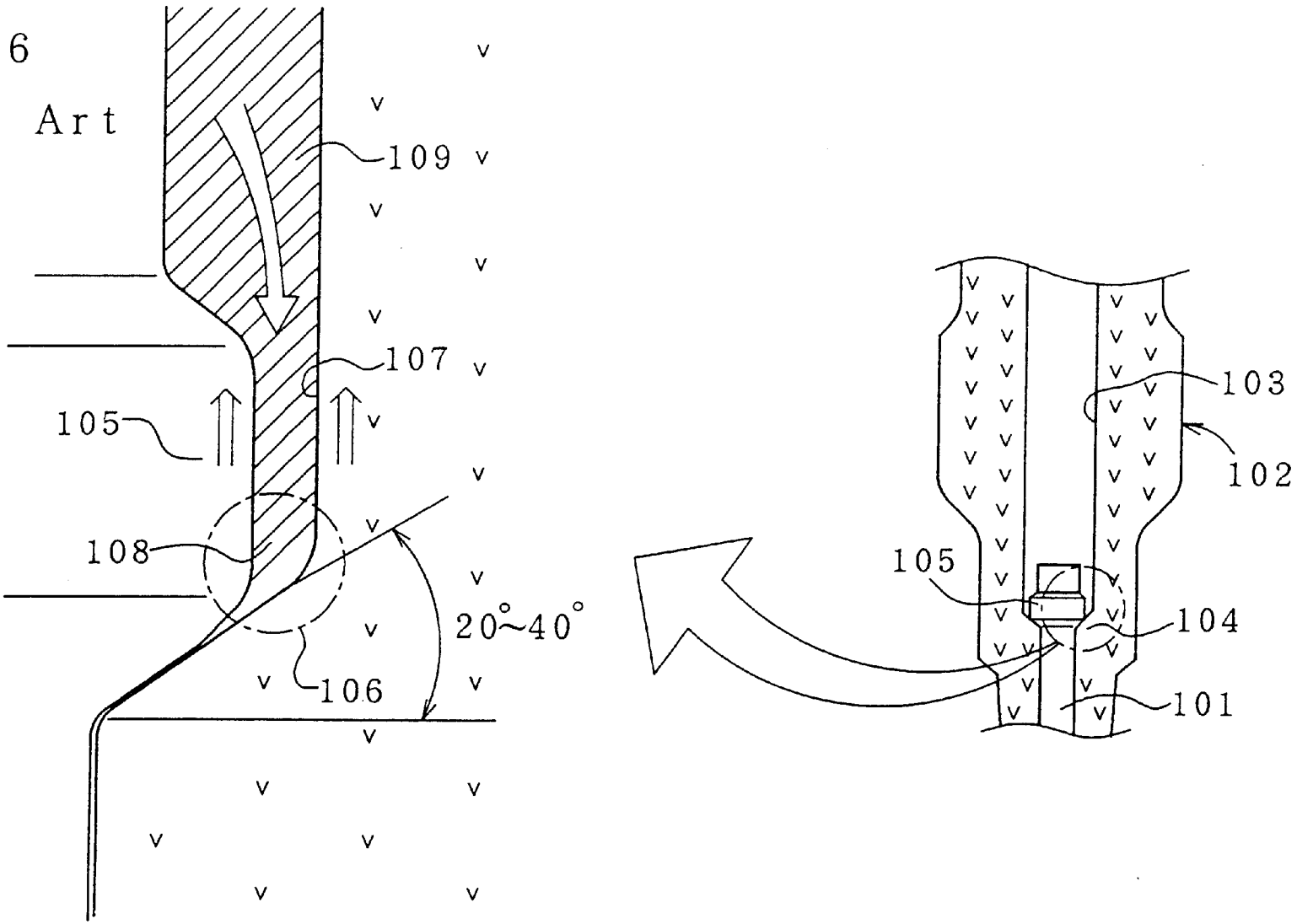
FIG. 16 Prior Art
FIG. 16 is a main-part sectional view, as well as an enlarged view thereof, of a spark plug according to the prior art.
Figure 17:
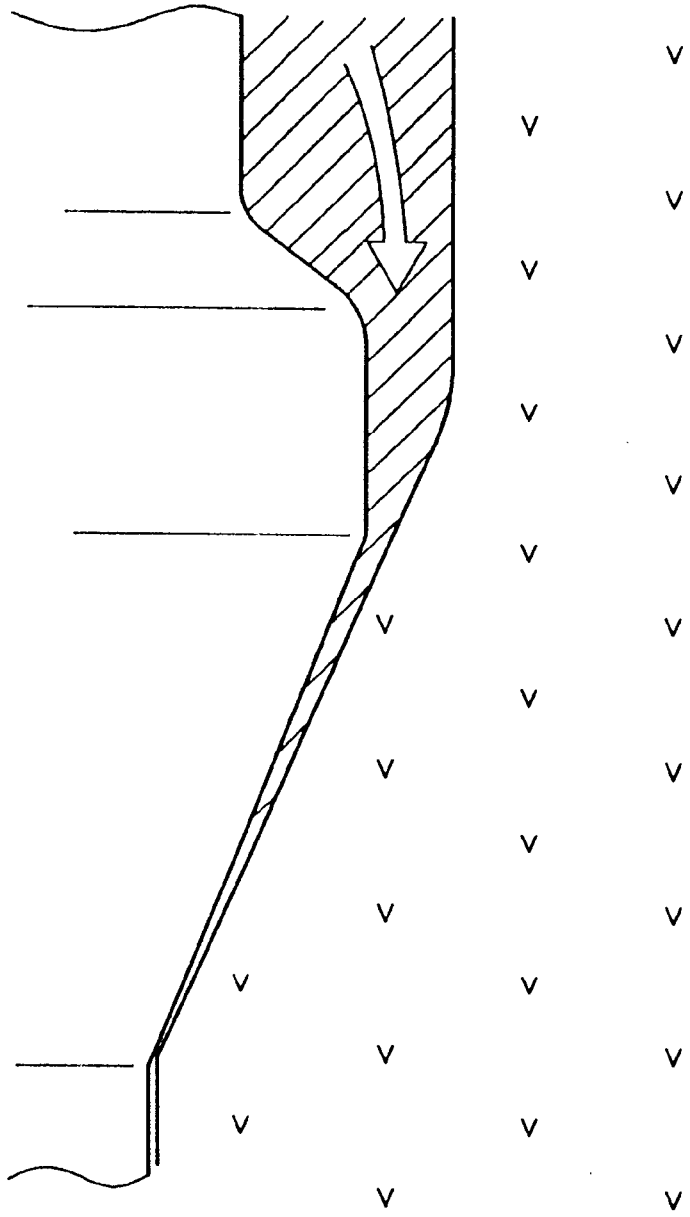
FIG. 17 is an explanatory view of a case where the taper angle at the connecting portion of the electrode-fixing protruding portion of the center electrode is set larger than the taper angle at the protruding-portion receiving surface.
Figure 18:
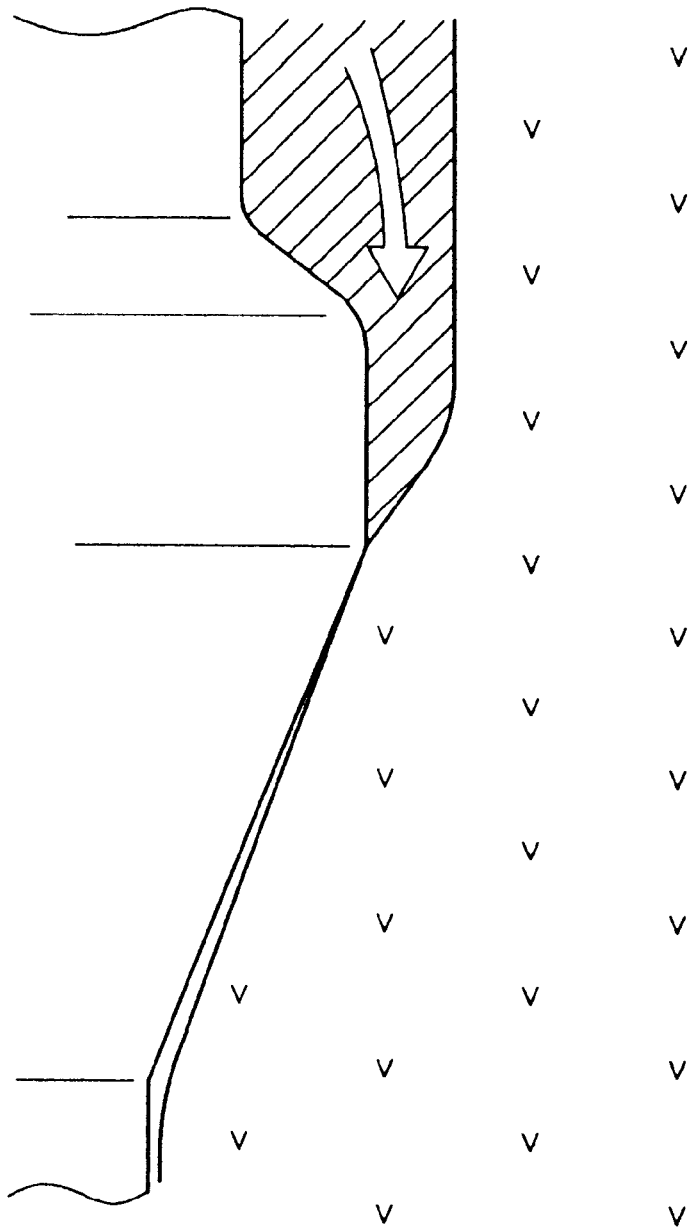
FIG. 18 is an explanatory view of a case where the taper angle at the connecting portion of the electrode-fixing protruding portion of the center electrode is set smaller than the taper angle at the protruding-portion receiving surface.

In spark plugs designated by sample Nos. 3–9 as shown in FIG. 14, which are products of the present invention, the taper angle of the protruding-portion receiving surface 325 (an angle formed by a taper surface 251 of the protruding-portion receiving surface 325 and a reference plane 252 perpendicular to the axis line of the through hole 320) is set to 45°–85°. Also, in the spark plugs designated by sample No. 1, No. 2 and No. 10, which are products for comparison, the taper angle (an angle formed by the taper surface 251 of the protruding-portion receiving surface 325 and the reference plane 252) is set to 30°, 40°and 90°, respectively.

The terminal 303, which is formed from low carbon steel and plated with nickel on the surface, comprises a terminal portion 331 projected from the rear end face 231, a tip end portion 332 sealed with glass in the through hole 320, and a bar-shaped portion 333 for connecting the terminal portion 331 and the tip end portion 332 to each other. The terminal portion 331 is formed at central portion into a smaller diameter for preventing the plug cap from falling off when it is fitted. The tip end portion 332 has its outer circumference machined into a screwed and knurled form, and sealed into the through hole 320 by the glass seal material 304 (conductive coupling portion in FIG. 12).

The glass seal material 304 is a melt and solidification of glass-based materials provided by putting together a second powder glass material, a resistor material and a first powder glass material in this order, and comprises a first electrically conductive glass seal portion 341, a resistor 342 and a second electrically conductive glass seal portion 343. The first and second powder glass materials are mixtures of copper powder and glass powder (e.g., mixing weight ratio: approx. 1:1). The resistor material is a mixture obtained by adding carbon powder, melt powder (Al, Sn etc.), ceramic powder and organic binder to glass powder.

The center electrode 305 has a bar-shaped portion 351 and an electrode-fixing protruding portion 352, where the electrode-fixing protruding portion 352 is engaged with the taper surface 251 of the protruding-portion receiving surface 325, the tip end of the bar-shaped portion 351 is inserted into the through hole 320 so as to be projected from the tip end face 322 of the insulator, by which the center electrode 305 is sealed into the through hole 320 by the glass seal material 304 (second conductive glass seal portion 343). In addition, in the electrode-fixing protruding portion 352, a taper surface 521 of barrel-shaped connecting portion is engaged with the taper surface 251, and a V-shaped cutout 522 is formed at a rear end.

This center electrode 305, which is a complex material of a sheath material made of nickel alloy and a core material (thermally conductive metal such as copper) to be sealed into the sheath material, is electrically connected to the terminal 303 via the glass seal material 304. The entire portion of the center electrode may be made of nickel or the alloy thereof. In addition, the glass seal process is carried out as in Example 1.

Next, a thermal resistance evaluation test conducted with the taper angle of the protruding-portion receiving surface 325 changed in various ways, and advantages of the invention products are described. First, spark plugs 200 in which the taper angle of the protruding-portion receiving surface 325 (an angle formed by the taper surface 251 of the protruding-portion receiving surface 325 and a radial plane 252) was set to 30°–90° (sample No. 1–No. 10 (five pieces for each one sample)) were prepared, mounted onto an engine 4-cycle single-cylinder 125 cc engine and run at 6000 rpm. FIG. 14 show plotted data of spark advances at which the ignition timing was advanced in turn. Also, the ignition timing was started with 20° CA, kept as it was for 1 minute, and changed in steps of 1° CA spark advance. In addition, the taper angle of the electrode-fixing protruding portion 352 of the center electrode 305 (an angle formed by the taper surface 521 of the connecting portion of the electrode-fixing protruding portion 352 and a radial plane 252) was set to the same value as the taper angle of the protruding-portion receiving surface 325.

It is noted that spark plugs of sample No. 10 in which the taper angle of the protruding-portion receiving surface 325 (an angle formed by the taper surface 251 of the protruding-portion receiving surface 325 and the radial plane 252) was set to 90° were not subjected to the thermal resistance evaluation test because the center electrode 305 was protruded to a more than specified extent in all those five spark plugs as shown in FIG. 14.

On the other hand, spark plugs 200 of sample Nos. 3–9 in which the taper angle of the protruding-portion receiving surface 325 (an angle formed by the taper surface 251 of the protruding-portion receiving surface 325 and the radial plane 252) was set to within a range of 45°–85° were confirmed that the thermal resistance is improved (by 4° CA–8° CA in spark advance) beyond the prior art spark plugs (with the taper angle of 20°–40°) and that the occurrence of preignitions can be suppressed.

Further, the spark plugs 200 of sample No. 3–9 were confirmed that variations in thermal resistance can be reduced as compared with the prior art spark plugs (as 6° CA–3° CA in spark advance) and therefore that the uniformity of product quality can be realized.

The effects obtained in the spark plugs 200 in which the taper angle of the taper surface 251 of the protruding-portion receiving surface 325 was set to 45°–85° (sample Nos. 3–9) that the anti-preignition performance is improved while variations in thermal resistance can be reduced so that a uniformity of product quality can be realized could be attributed to the following reasons:

Because the taper angle of the taper surface 251 $\phi$ of the protruding-portion receiving surface 325 is set large (45°–85°), the flow resistance of the second conductive glass seal portion 343 at the inner wall of the through hole in the vicinity of the protruding-portion receiving surface 325 is suppressed low so that a sufficient fluidity can be ensured. As a result, pressure propagation at the time of heating and sealing is not impaired, so that the vitrifiability (thermal conductivity) in minute spaces (hereinafter, referred to as seal portions) present between the taper surface 521 of the connecting portion of the electrode-fixing protruding portion 352 of the center electrode 305 and the taper surface 251 of the protruding-portion receiving surface 325 can be improved.

The high vitrifiability of the seal portions lead to an excellent thermal conductivity, so that the thermal resistance performance (anti-preignition performance) of the spark plugs 200 can be improved. Also, because of the uniform vitrifiability of the seal portions, the thermal resistance performance (anti-preignition performance) of the spark plugs 200 can be made generally uniform from product to product.

Next, an impact test in which the taper angle of the taper surface 251 of the protruding-portion receiving surface 325 was changed in various ways, as well as advantages of the present invention are described. FIG. 15 show results of evaluation by the impact test as defined in paragraph 3.3 of JISB8031 with spark plugs 200 (five pieces for one sample) in which the taper angle of the protruding-portion receiving surface 325 was set to 50°, and the taper angle of the connecting portion of the electrode-fixing protruding portion 352 of the center electrode 305 was set to +0°, +5°, +7° with respect to the taper angle $\phi$ of the protruding-portion receiving surface 325. This test was conducted with a 22 mm travel for 10 minutes for each sample. Then, test samples satisfying the specification that the rate of change of resistance after the completion of the test falls within a range of ±10% were expressed as o, and test samples departing from the specification were expressed as x.

Some of the samples having the 7° taper angle of the protruding-portion receiving surface 325 fell outside the specification, and it was verified that the impact resistance decreases with increasing taper angle of the connecting portion of the electrode-fixing protruding portion 352.

Also, as a result of ascertaining the state of the second conductive glass seal portion 343 by cutting the samples that had been subjected to this test, it proved that the degree of compactness of the second conductive glass seal portion 343 in the seal portion differs among the samples. That is, whereas no significant differences were seen in the compactness of the second conductive glass seal portion 343 in the outer circumferential surface of the electrode-fixing protruding portion 352 of the center electrode 305, it was seen that the compactness of the second conductive glass seal portion 343 in the aforementioned minute spaces (seal portions) gradually decreases as the taper angle of the connecting portion of the electrode-fixing protruding portion 352 of the center electrode 305 is set larger. Therefore, it can be considered that as a result of conducting the impact test, the second conductive glass seal portion 343 in the minute portions, if low in the degree of compactness, is liable to crack so that the stability of the center electrode 305 would deteriorate.

TABLE 1

| No. | d, D | d/D | θ | 1, L | 1/L | Rate of change for spark durability R value (%) |
|---|---|---|---|---|---|---|
| *1 | 4.0, 4.0 | 1.0 | 30° | 0, 3.0 | 0 | Not discharged |
| 2 | 3.9, 4.0 | 0.975 | 30° | 1.0, 3.0 | 0.33 | +200 |
| 3 | 3.9, 4.0 | 0.975 | 30° | 3.0, 3.0 | 1.0 | +100 |
| 4 | 3.7, 4.0 | 0.925 | 20° | 1.5, 3.0 | 0.5 | +10 |
| 5 | 3.7, 4.0 | 0.925 | 30° | 1.5, 3.0 | 0.5 | +5 |
| 6 | 3.7, 4.0 | 0.925 | 50° | 1.5, 3.0 | 0.5 | +5 |
| 7 | 3.7, 4.0 | 0.925 | 80° | 1.5, 3.0 | 0.5 | +5 |
| 8 | 3.7, 4.0 | 0.925 | 85° | 1.5, 3.0 | 0.5 | +50 |
| 9 | 3.7, 4.0 | 0.925 | 30° | 4.5, 3.0 | 1.5 | −10 |
| 10 | 3.7, 4.0 | 0.925 | 50° | 4.5, 3.0 | 1.5 | −12 |
| 11 | 3.7, 4.0 | 0.925 | 80° | 4.5, 3.0 | 1.5 | −8 |
| 12 | 3.7, 4.0 | 0.925 | 30° | 9.0, 3.0 | 3.0 | −10 |
| 13 | 3.7, 4.0 | 0.925 | 50° | 9.0, 3.0 | 3.0 | −11 |
| 14 | 3.7, 4.0 | 0.925 | 80° | 9.0, 3.0 | 3.0 | +5 |
| 15 | 3.7, 4.0 | 0.925 | 85° | 9.0, 3.0 | 3.0 | +50 |

*The mark * denotes that the sample falls outside the scope of the present invention.

TABLE 2

| No. | d, D | d/D | θ | 1, L | 1/L | Rate of change for spark durability R value (%) |
|---|---|---|---|---|---|---|
| 16 | 3.0, 4.0 | 0.75 | 10° | 1.5, 3.0 | 0.5 | +42 |
| 17 | 3.0, 4.0 | 0.75 | 30° | 1.5, 3.0 | 0.5 | +5 |
| 18 | 3.0, 4.0 | 0.75 | 50° | 1.5, 3.0 | 0.5 | −10 |
| 19 | 3.0, 4.0 | 0.75 | 80° | 1.5, 3.0 | 0.5 | +0 |
| 20 | 3.0, 4.0 | 0.75 | 85° | 1.5, 3.0 | 0.5 | +45 |
| 21 | 3.0, 4.0 | 0.75 | 30° | 4.5, 3.0 | 1.5 | −12 |
| 22 | 3.0, 4.0 | 0.75 | 50° | 4.5, 3.0 | 1.5 | −15 |
| 23 | 3.0, 4.0 | 0.75 | 80° | 4.5, 3.0 | 1.5 | +0 |
| 24 | 3.0, 4.0 | 0.75 | 30° | 1.0, 3.0 | 0.33 | +45 |
| 25 | 2.0, 4.0 | 0.50 | 30° | 4.5, 3.0 | 1.5 | +10 |
| 26 | 2.0, 4.0 | 0.50 | 50° | 4.5, 3.0 | 1.5 | +0 |
| 27 | 2.0, 4.0 | 0.50 | 80° | 4.5, 3.0 | 1.5 | +10 |
| 28 | 1.5, 4.0 | 0.375 | 30° | 4.5, 3.0 | 1.5 | +55 |
| 29 | 1.5, 4.0 | 0.375 | 50° | 4.5, 3.0 | 1.5 | +60 |
| 30 | 1.5, 4.0 | 0.375 | 80° | 4.5, 3.0 | 1.5 | +60 |

What is claimed is:

1. A spark plug comprising:

an insulator;

a through hole formed along an axial direction of the insulator;

a terminal inserted and fixed on one end side of the through hole;

a center electrode inserted and fixed on a second end side of the through hole;

a resistor placed between the terminal and the center electrode within the through hole;

wherein a stem cross-section diameter of the center electrode is set smaller than a stem cross-section diameter of the resistor;

wherein one side toward a tip end of the center electrode taken as a front side, the through hole of the insulator has a first portion which allows the center electrode to be inserted therethrough, and a second portion which is formed on a rear side of the first portion so as to be larger in diameter than the first portion and which accommodates the resistor therein;

wherein the second portion is connected to the first portion via a connecting portion including a two-or more-stepped reduced-diameter portions; and an electrically conductive glass seal portion placed at a position corresponding to the connecting portion between the resistor and the center electrode, and wherein the electrically conductive glass of said glass seal portion is sealed into a narrow gap between an outer radial surface of said center electrode and said connecting portion of said through hole.

2. The spark plug according to claim 1, wherein an electrode-fixing protruding portion is provided at a rear end portion of the center electrode so as to be protruded outward from an outer circumferential surface of the center electrode, and at the connecting portion, a protruding-portion receiving surface for receiving the electrode-fixing protruding portion is formed so as to be adjacent to a rear end edge of the first portion and to be projected outward from an inner circumferential surface of the first portion, and further, a projecting portion is formed in correspondence to a position at which an outward extended surface of the protruding-portion receiving surface and an extended surface of the second portion toward the protruding-portion receiving surface cross each other, so that the projecting portion stretches over these two extended surfaces.

3. A spark plug comprising:

an insulator;

a through hole formed along an axial direction of the insulator;

a terminal inserted and fixed on one end side of the through hole;

a center electrode inserted and fixed on a second end side of the through hole;

a resistor placed between the terminal and the center electrode within the through hole;

wherein a stem cross-section diameter of the center electrode is set smaller than a stem cross-section diameter of the resistor;

wherein one side toward a tip end of the center electrode taken as a front side, the through hole of the insulator has a first portion which allows the center electrode to be inserted therethrough, and a second portion which is formed on a rear side of the first portion so as to be larger in diameter than the first portion and which accommodates the resistor therein;

wherein the second portion is connected to the first portion via a connecting portion including a two-or more-stepped reduced-diameter portions; and an electrically conductive glass seal portion placed at a position corresponding to the connecting portion between the resistor and the center electrode, and wherein the electrically conductive glass of said glass seal portion is sealed into a narrow gap between an outer surface of said center electrode and said connecting portion of said through hole, wherein an electrode-fixing protruding portion is provided at a rear end portion of the center electrode so as to be protruded outward from the first inner circumferential surface, and at the connecting portion, a protruding-portion receiving surface for receiving the electrode-fixing protruding portion is formed so as to be adjacent to a rear end edge of the first portion and to be projected outward from an inner circumferential surface of the first portion, and further, a protecting portion is formed in correspondence to a position at which an outward extended surface of the protruding-portion receiving surface and an extended surface of the second portion toward the protruding-portion receiving surface cross each other, so that the protecting portion stretches over these two extended surfaces, wherein a cross section including a center axis line of the insulator, wherein a distance in the direction of the center axis line from a connecting point P between the protruding-portion receiving surface and the first portion to a connecting point S between a surface of a projecting portion (hereinafter, referred to as a projecting surface) and the second portion is 1 and a distance in the direction of the center axis line from the connecting point P to the rear end edge of the center electrode is L, then a value of 1/L is not less than 0.5.

4. A spark plug comprising:

an insulator;

a through hole formed along an axial direction of the insulator;

a terminal inserted and fixed on one end side of the through hole;

a center electrode inserted and fixed on a second end side of the through hole;

a resistor placed between the terminal and the center electrode within the through hole;

wherein a stem cross-section diameter of the center electrode is set smaller than a stem cross-section diameter of the resistor;

wherein one side toward a tip end of the center electrode taken as a front side, the through hole of the insulator has a first portion which allows the center electrode to be inserted therethrough, and a second portion which is formed on a rear side of the first portion so as to be larger in diameter than the first portion and which accommodates the resistor therein;

wherein the second portion is connected to the first portion via a connecting portion including a two-or more-stepped reduced-diameter portions; and an electrically conductive glass seal portion placed at a position corresponding to the connecting portion between the resistor and the center electrode, and wherein the electrically conductive glass of said glass seal portion is sealed into a narrow gap between an outer surface of said center electrode and said connecting portion of said through hole, wherein the second portion is formed into a generally cylindrical surface, and a projecting surface of the connecting portion has a generally cylindrical shell surface which is connected to the protruding-portion receiving surface and arranged concentrically with the second portion, and a reduced-diameter surface which connects the second portion and the shell surface to each other, and with an inner diameter of the second portion expressed as D and with an inner diameter of the shell surface expressed as d, a value of d/D is adjusted to within a range of 0.5–0.95.

5. The spark plug according to claim 3, wherein the second portion is formed into a generally cylindrical surface, and the projecting surface of the connecting portion has a generally cylindrical shell surface which is connected to the protruding-portion receiving surface and arranged concentrically with the second portion, and a reduced-diameter surface which connects the second portion and the shell surface to each other, and the reduced-diameter surface of the projecting surface is formed into a taper surface which is sloped upward toward an outside when the insulator is positioned upright with the first portion down, while with a plane perpendicular to the center axis line of the through hole taken as a reference plane, a slope angle θ of the taper surface to the reference plane is adjusted within a range of 20–80°.

6. A spark plug having a through hole formed along an axial direction of an insulator, a terminal inserted and fixed on one end side of the through hole while a center electrode is inserted and fixed on the other end side of the through hole, and a resistor is placed between the terminal and the center electrode within the through hole further comprising;

a stem cross-section diameter of the center electrode is set smaller than a stem cross-section diameter of the resistor, and with one side toward a tip end of the center electrode taken as a front side, the through hole of the insulator has a first portion which allows the center electrode to be inserted therethrough, and a second portion which is formed on a rear side of the first portion so as to be larger in diameter than the first portion and which accommodates the resistor therein;

an electrode-fixing protruding portion formed at a rear end portion of the center electrode so as to be projected outward from an outer circumferential surface of the center electrode; and at a connecting portion between the first portion and the second portion, a protruding-portion receiving surface for receiving the electrode-fixing protruding portion is formed in such a shape as to be adjacent to a rear end edge of the first portion and be projected outward from an inner circumferential surface of the first portion, and further, a projecting portion of an inward protrusion which is formed in correspondence to a position (C) at which at first outward extended surface of the protruding-portion receiving surface and a second extended surface of the second portion toward a protruding-portion receiving surface side cross each other, wherein the projecting portion stretches over these two extended surfaces, and wherein the electrically conductive glass of said glass seal portion is sealed into a narrow radial gap between said electrode-fixing protruding portion of said center electrode and said projecting portion of said through hole.

7. The spark plug according to claim 6, wherein the second portion is formed into a generally cylindrical surface, and a surface of the projecting portion (hereinafter, referred to as a projecting surface) of the connecting portion has a generally cylindrical shell surface which is connected to the protruding-portion receiving surface and arranged concentrically with the second portion, and a reduced-diameter surface which connects the second portion and the shell surface to each other.

8. The spark plug according to claim 7, wherein in the connecting portion, the reduced-diameter surface of the projecting surface is formed into a taper surface which is sloped upward toward an outside when the insulator is positioned upright with the first portion down.

9. A spark plug comprising:

an insulator placed inside a cylindrical metal shell;

a through hole formed along an axial direction of the insulator, wherein a terminal is inserted and fixed on one end side of the through hole while a center electrode is inserted and fixed on the other end side of the through hole;

an electrically conductive coupling portion formed in the through hole between the terminal and the center electrode, the electrically conductive coupling portion comprising electrically conductive glass seal portions and serving for connecting the terminal and the center electrode to each other;

wherein a first portion of the through hole located on the front side of a tapered protruding-portion receiving surface is formed into a first portion of a smaller diameter, while a portion of the through hole located on the rear side of the protruding-portion receiving surface is formed into a second portion of a larger diameter;

the center electrode has, in the through hole, a bar-shaped center-electrode body portion which is inserted into the first portion and an electrode fixing protruding portion which is formed at a rear end portion of the center-electrode body portion so as to be protruded outward from an outer circumferential surface of the center-electrode body portion and which is engaged with the protruding-portion receiving surface; and a taper angle of the protruding-portion receiving surface set to 45°–85° as an angle viewed from a reference plane perpendicular to a center axis line of the through hole, and wherein one electrically conductive glass of said glass seal portion is sealed into a narrow gap between the outer radial surface of said center electrode and said second portion of said through hole.

10. The spark plug according to claim 9, wherein the electrically conductive coupling portion comprises a first electrically conductive glass seal portion, a resistor and a second electrically conductive glass seal portion which are formed in this order from the terminal side in the through hole;

a terminal inserted into the through hole so that a terminal portion is protruded from a rear end face of the insulator, and wherein a tip end portion of the terminal is sealed in the through hole by the first electrically conductive glass seal portion, and the electrode-fixing (3*a*) protruding portion is sealed within the through hole by a second electrically conductive glass seal portion.

11. The spark plug according to claim 9, wherein the taper angle $\phi$ of the protruding-portion receiving surface is 60° to 85°.

12. The spark plug according to claim 9, wherein the taper angle $\phi$ of the protruding-portion receiving surface is 75° to 85°.

13. The spark plug according to claim 9, wherein the taper angle of a tapered connecting portion between the electrode-fixing protruding portion and the center-electrode body portion, with which the protruding-portion receiving surface makes contact, is set to not more than $(\phi+5)°$ where the taper angle of the protruding-portion receiving surface is $\phi$.

14. The spark plug according to claim 10, wherein the taper angle of the protruding-portion receiving surface $\phi$ is 60° to 85°.

15. The spark plug according to claim 10, wherein the taper angle $\phi$ of the protruding-portion receiving surface is 75° to 85°.

16. The spark plug according to claim 10, wherein the taper angle of a tapered connecting portion between the electrode-fixing protruding portion and the center-electrode body portion, with which the protruding-portion receiving surface makes contact, is set to not more than $(\phi+5)°$ where the taper angle of the protruding-portion receiving surface is $\phi$.

17. The spark plug according to claim 11, wherein the taper angle of a tapered connecting portion between the electrode-fixing protruding portion and the center-electrode body portion, with which the protruding-portion receiving surface makes contact, is set to not more than $(\phi+5)°$ where the taper angle of the protruding-portion receiving surface is $\phi$.

18. The spark plug according to claim 12, wherein the taper angle of a tapered connecting portion between the electrode-fixing protruding portion and the center-electrode body portion, with which the protruding-portion receiving surface makes contact, is set to not more than $(\phi+5)°$ where the taper angle of the protruding-portion receiving surface is 100 .

* * * * *

UNITED STATES PATENT AND TRADEMARK OFFICE

CERTIFICATE OF CORRECTION

PATENT NO. : 6,191,525 B1
DATED : February 20, 2001
INVENTOR(S) : Yutaka Tanaka and Makoto Sugimoto It is certified that error appears in the above-identified patent and that said Letters Patent is hereby corrected as shown below:

Title page,
Delete "SPARK PLUG" and substitute therefore -- SPARK PLUG HAVING AN INSULATOR WITH A THROUGH-HOLE COMPRISING FIRST AND SECOND PORTIONS THAT ARE CONNECTED VIA A TWO OR MORE REDUCED DIAMETER PORTION --

Column 22,
Delete "100" and substitute therefor -- $\phi$ --

Signed and Sealed this

Sixteenth Day of April, 2002

*Attest:*

*Attesting Officer*

JAMES E. ROGAN
*Director of the United States Patent and Trademark Office*